US006217291B1

(12) United States Patent
Ota et al.

(10) Patent No.: US 6,217,291 B1
(45) Date of Patent: Apr. 17, 2001

(54) CONTROL VALVE FOR VARIABLE DISPLACEMENT COMPRESSORS AND METHOD FOR VARYING DISPLACEMENT

(75) Inventors: Masaki Ota; Taku Adaniya; Kenta Nishimura; Hirotaka Kurakake, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/295,165

(22) Filed: Apr. 20, 1999

(30) Foreign Application Priority Data

Apr. 21, 1998 (JP) ..... 10-110850
Jan. 12, 1999 (JP) ..... 11-005357

(51) Int. Cl.[7] ..... F04B 1/26
(52) U.S. Cl. ..... 417/222.2
(58) Field of Search ..... 417/222.2

(56) References Cited

U.S. PATENT DOCUMENTS 4,687,419 * 8/1987 Suzuki et al. ..... 417/222.2
5,000,666 * 3/1991 Esaki ..... 417/222.2
5,205,718 * 4/1993 Fujisawa et al. ..... 417/222.2
5,240,385 * 8/1993 Nashiro et al. ..... 417/222.2
5,547,346 * 8/1996 Kanzaki et al. ..... 417/222.2
5,586,870 * 12/1996 Kawaguchi et al. ..... 417/222.2
5,865,604 * 2/1999 Kawaguchi et al. ..... 417/222.2
5,971,716 * 10/1999 Ota et al. ..... 417/222.2
6,010,312 * 1/2000 Suitou et al. ..... 417/222.2

FOREIGN PATENT DOCUMENTS 0 258 680 A1 3/1988 (EP) .
0 448 372 A1 9/1991 (EP) .
0 814 262 A2 12/1997 (EP) .
8-338364 12/1996 (JP) .

OTHER PUBLICATIONS

EP 99 10 6299 Search Report dated Jan. 19, 2000.

* cited by examiner

*Primary Examiner*—Charles G. Freay
(74) *Attorney, Agent, or Firm*—Woodcock Washburn Kurtz Mackiewicz & Norris LLP

(57) ABSTRACT

A control valve varies the displacement of a variable displacement compressor. A pressure chamber is connected to a suction chamber through a fixed throttle and to a discharge chamber through an intake passage. The intake passage includes a fixed throttle and an electromagnetic valve. A controller controls the electromagnetic valve in accordance with data related to the running conditions of the vehicle. The control valve has a threshold value that changes in accordance with the opening and closing of the electromagnetic valve.

15 Claims, 11 Drawing Sheets

CONTROL VALVE FOR VARIABLE DISPLACEMENT COMPRESSORS AND METHOD FOR VARYING DISPLACEMENT

BACKGROUND OF THE INVENTION

The present invention relates to compressors for compressing and discharging gas, and more particularly, to a compressor that varies displacement in accordance with the difference between the pressure of a discharge chamber and the pressure of a crank chamber, a control valve for controlling the pressure difference, and a method for varying the displacement of the compressor.

FIG. 20 shows a prior art compressor 200. An inclinable swash plate 201 is accommodated in a crank chamber 203. The displacement of the compressor 200 varies in accordance with the inclination of the swash plate 201. A control valve 202 controls the pressure of the crank chamber 203 to alter the inclination of the swash plate 201. The inclination of the swash plate 201 changes the stroke of pistons 204, which are retained in the compressor 200. There are two types of control valves 202, a self-controlled type and an externally controlled type.

A self-controlled type control valve detects the suction pressure of the compressor 200. The control valve automatically controls its position in accordance with the difference between the detected suction pressure value and a threshold pressure value. The threshold value is determined by the characteristics of a pressure sensing member (bellows), which is retained in the control valve. Accordingly, in a self-controlled type control valve, the threshold value cannot be changed when the compressor is operating.

In a externally controlled control valve, the threshold value can be changed when the compressor is operating. Typically, the externally controlled valve has an electromagnetic actuator and a controller 207. The electromagnetic actuator includes a solenoid 206 and other relevant parts (e.g., steel core). In the control valve, the solenoid 206 is arranged coaxially with a pressure sensing member. The controller 207 controls the electromagnetic actuator in accordance with data sent from various types of sensors (e.g., ambient temperature). The electromagnetic actuator is actuated to change the threshold value. The threshold value is changed to vary and optimize the displacement of the compressor under different conditions.

Since the prior art self-controlled control valve cannot change the threshold value, the displacement of a compressor using such a valve cannot be flexibly varied. Although the externally controlled control valve can change the threshold value in accordance with the conditions surrounding the compressor, the electromagnetic actuator, which includes the solenoid and other relevant parts, increases the size of the compressor and complicates the structure of the compressor. This increases the product costs of the compressor. Furthermore, an amplifier having a large electric capacity must be used to actuate the electromagnetic actuator, which is controlled by the controller. However, the employment of a compressor using a high-capacity amplifier in an automotive air conditioning system significantly increases the load applied to the vehicle.

SUMMARY OF THE INVENTION

Accordingly, it is an objective of the present invention to provide a control valve that easily varies the displacement of a compressor, a compressor using such a control valve, and a method for varying the displacement of a compressor.

To achieve the above objective, the present invention provides a control valve installed in a variable displacement compressor for compressing gas. The compressor includes a discharge pressure region, a suction pressure region, and a crank chamber. The pressure in the discharge pressure region is higher than that of the suction pressure region. The crank chamber accommodates a crank mechanism for compressing the gas. The control valve changes the displacement of the compressor by controlling a difference between the pressure in the crank chamber and the pressure in the discharge pressure region or the suction pressure region. The control valve has the following structure. A pressure sensitive chamber is connected to a control region, which is one of the discharge pressure region or the suction pressure region. A first passage connects the crank chamber to the control region. A valve chamber is located in the first passage. A valve body is accommodated in the valve chamber for selectively closing and opening the first passage. A displaceable pressure sensitive mechanism is connected to the valve body and accommodated in the pressure sensitive chamber. The displacement of the pressure sensitive mechanism causes the valve body to move between an open position and a closed position. The pressure sensitive mechanism produces a force for determining an initial threshold pressure value at which the valve body is switched between the open position and the closed position. A controller controls the pressure in the pressure sensitive chamber by supplying gas from the discharge pressure region to the pressure sensitive chamber or by discharging gas from the pressure sensitive chamber to the suction pressure region to change the threshold value from the initial value to a second threshold value. The pressure sensitive mechanism functions in accordance with the pressure of the pressure sensitive chamber. The valve body behaves in accordance with the threshold value selected by the controller.

The present invention further provides a variable displacement compressor for compressing gas. The compressor includes a discharge pressure region and a suction pressure region. The pressure in the discharge pressure region is higher than that of the suction pressure region. The compressor has the following structure. A crank chamber accommodates a crank mechanism for compressing the gas. A control valve changes the displacement of the compressor by controlling a difference between the pressure in the crank chamber and the pressure in a control region, which is one of the discharge pressure region or the suction pressure region. The control valve has the following structure. A pressure sensitive chamber is connected to the control region. A first passage connects the crank chamber to the control region. A valve chamber is located in the first passage. A valve body is accommodated in the valve chamber for selectively closing and opening the first passage. A displaceable pressure sensitive mechanism is connected to the valve body and accommodated in the pressure sensitive chamber. The displacement of the pressure sensitive mechanism causes the valve body to move between an open position and a closed position. The pressure sensitive mechanism produces a force for determining an initial threshold pressure value at which the valve body is switched between the open position and the closed position. The compressor further includes a controller that controls the pressure in the pressure sensitive chamber by supplying gas from the discharge pressure region to the pressure sensitive chamber or by discharging gas from the pressure sensitive chamber to the suction pressure region to change the threshold value from the initial value to a second value. The pressure sensitive mechanism functions in accordance with the pressure of the pressure sensitive chamber. The valve body behaves in accordance with the threshold value selected by the controller.

The present invention further provides a method for controlling a displacement of a variable displacement compressor installed in a vehicle. The compressor has a discharge pressure region, a suction pressure region, a crank chamber, which accommodates a crank mechanism for compressing gas, and a control valve. The pressure in the discharge pressure region is higher than that of the suction pressure region. The control valve has the following structure. A valve body selectively closes and opens a passage that connects the crank chamber to the discharge pressure region or the suction pressure region. A pressure sensitive chamber is connected to the discharge pressure region or the suction pressure region. The control valve changes the displacement of the compressor by regulating the difference between the pressure in the crank chamber and the pressure in the discharge pressure region or the suction pressure region. The method includes the steps of as follows: detecting a driving state of the vehicle; and supplying gas from the discharge pressure region to the pressure sensitive chamber to increase the pressure in the pressure sensitive chamber in response to the driving state.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
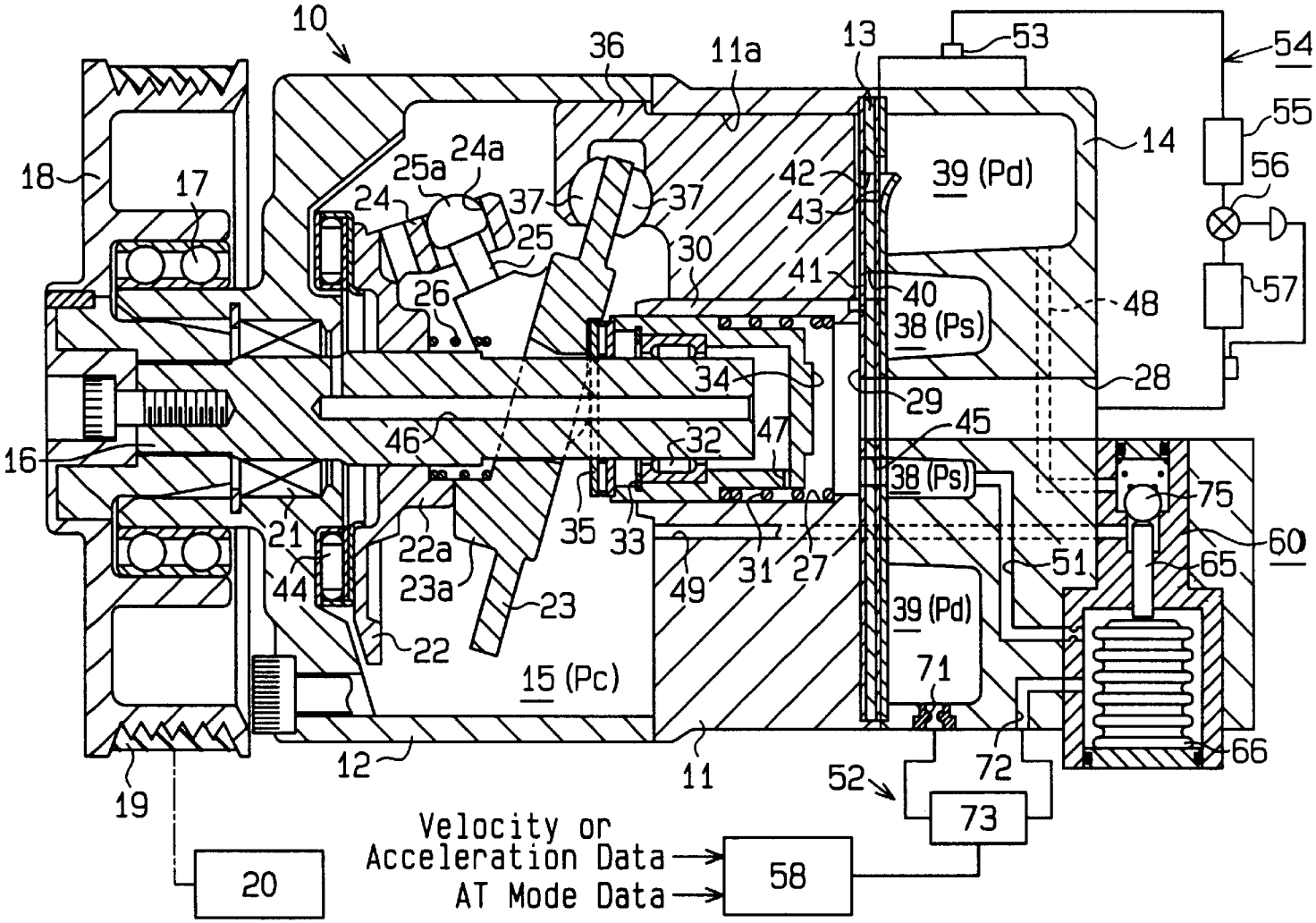
FIG. 1 is a cross-sectional view showing a compressor according to a first embodiment of the present invention.

The present invention embodied in a variable displacement compressor 10 will now be described with reference to the drawings. To avoid a redundancy, like or same reference numerals are given to those components that are the same or similar in all embodiments.

First Embodiment

As shown in FIG. 1, a front housing 12 is fixed to the front end of a cylinder block 11. A rear housing 14 is fixed to the rear end of the cylinder block 11 with a valve plate 13 arranged in between. A crank chamber 15 is arranged in the front housing 12 in front of the cylinder block 11.

A rotatable drive shaft 16 extends through the crank chamber 15 between the front housing 12 and the cylinder block 11. The front end of the drive shaft 16 projects out of the crank chamber 15. A pulley 18 is secured to the projected end of the drive shaft 16. The pulley 18 is supported by the front housing 12 by means of an angular bearing 17 and connected to an engine 20 by a belt 19. In other words, the compressor 10 is a clutchless type variable displacement compressor. That is, a clutch is not used to connect the drive shaft 16 to an external drive source, or engine 20.

A swash plate 23, which serves as a cam plate, is supported such that it inclines and slides along the drive shaft 16 in the crank chamber 15. A pair of guide pins 25 is fixed to the swash plate 23. Round guides 25*a* are provided on the distal end of each guide pin 25. A rotor 22 is fixed to the drive shaft 16 in the crank chamber 15 to rotate integrally with the drive shaft 16. The rotor 22 has a support arm 24, which extends toward the swash plate 23. The support arm 24 has a pair of guide bores 24*a*. Each guide bore 24*a* slidably accommodates one of the guide pins 25. The engagement between the support arm 24 and the guide pins 25 rotates the swash plate 23 integrally with the drive shaft 16, while permitting movement of the swash plate 23 along the surface of the drive shaft 16 and guiding inclination of the swash plate 23. The inclination of the swash plate 23 decreases as it moves rearward toward the cylinder block 11. The support arm 24 and the guide pins 25 define a hinge mechanism. The swash plate 23 has a counterweight 23*a* located on the opposite side of the drive shaft 16 from the hinge mechanism.

A first spring 26 is arranged between the rotor 22 and the swash plate 23. The first spring 26 urges the swash plate 23 toward the rear (rightward in FIG. 1). A projection 22*a* is formed on the rear surface of the rotor 22. When the swash plate 23 comes into contact with the projection, further inclination of the swash plate 23 is prohibited. In this state, the swash plate 23 is located at a maximum inclination position.

A central bore 27 extends through the cylinder block 11 along the axis of the drive shaft 16. A cylindrical cup-like shutter 30 is accommodated in the central bore 27 and supported so that it slides along the axis of the drive shaft 16. The shutter 30 has a peripheral surface with a stepped portion. The wall of the central bore 27 also has a stepped portion. A second spring 31 is arranged between the stepped portion of the shutter 30 and the stepped portion of the central bore 27 to urge the shutter 23 toward the swash plate 23.

A radial bearing 32 is arranged between the rear end portion of the drive shaft 16 and the inner wall of the shutter 30. A snap ring 33 prevents the radial bearing 32 from falling out of the shutter 30. The radial bearing 32 moves together with the shutter 30 in the axial direction of the drive shaft 16. Accordingly, the rear end portion of the drive shaft 16 is rotatably supported in the central bore 27 by the shutter 30 and the radial bearing 32. The central bore 27 is connected with a suction passage 28. A shutting surface 34 is defined on the rear end of the shutter 30. When the shutter 30 moves rearward, the shutting surface 34 contacts the positioning surface 29, which is defined on the valve plate 13. In this state, the suction passage 28 is disconnected from the central bore 27.

A thrust bearing 35 is arranged between the swash plate 23 and the shutter 30. The thrust bearing 35 slides along the drive shaft 16 and is constantly clamped between the swash plate 23 and the shutter 30 by the forces of the first and second springs 26, 31.

The inclination of the swash plate 23 decreases as it moves toward the rear. As the swash plate 23 moves rearward, the thrust bearing 35 moves the shutter 30 toward the positioning surface 29 against the force of the second spring 31. When the shutting surface 34 contacts the positioning surface 29, the swash plate 23 is located at a minimum inclination position, while the shutter 30 is located at a shutting position. In this state, the inclination of the swash plate 23, with respect to a plane perpendicular to the axis of the drive shaft 16, is slightly greater than zero degrees.

Cylinder bores 11*a* (only one shown) extend about the drive shaft 16 in the cylinder block 11. A piston 36 is accommodated in each cylinder bore 11*a*. Each piston 36 is operably connected to the swash plate 23 by means of shoes 37. The rotation of the drive shaft 16 is transmitted to the swash plate 23 by the rotor 22. The shoes 37 convert the rotation of the swash plate 23 to reciprocal movement of each piston 36 in the associated cylinder bore 11*a*.

An alteration in the inclination of the swash plate 23 changes the stroke of the pistons 36 and varies the displacement. The hinge mechanism (the support arm 24 and the guide pins 25) keeps the upper dead center position of each piston 36 at the same location regardless of the swash plate inclination. The distance between the head of each piston 36, when located at the top dead center position, and the valve plate 13 is substantially null.

An annular suction chamber 38 is defined about the suction passage 28 in the central portion of the rear housing 14. An annular discharge chamber 39 is defined about the suction chamber 38. The suction chamber 38 is connected to the central bore 27 through a communication port 45 extending through the valve plate 13. The suction chamber 38 and the suction passage 28 are disconnected from each other when the shutter 30 is located at the shutting position.

A suction port 40 and a discharge port 42 extend through the valve plate 13 in correspondence with each cylinder bore 11*a*. A suction flap 41 is provided on the valve plate 13 in correspondence with each suction port 40. A discharge flap 43 is provided on the valve plate 13 in correspondence with each discharge port 42.

As each piston 36 performs the suction stroke and moves from its top dead center position to its bottom dead center position in the associated cylinder bore 11*a*, the refrigerant gas in the suction chamber 38 enters the suction port 40, opens the suction flap 41, and enters the cylinder bore 11*a*. As each piston 36 performs the compression stroke and moves from the bottom dead center position to the top dead center position in the associated cylinder bore 11*a*, the refrigerant gas is compressed in the cylinder bore 11*a*. The compressed gas then enters the discharge port 42, opens the discharge flap 43, and flows out into the discharge chamber 39. The compression reaction of the refrigerant gas produced during the compression stroke is received by the front housing 12 by way of the pistons 36, the rotor 22, and the thrust bearing 44.

A relief passage 46 extends through the drive shaft 16 and connects the crank chamber 15 to the interior of the shutter 30. A relief bore 47 extends through the cylindrical wall of the shutter 30 to function as a throttle valve. The relief bore 47 connects the central bore 27 to the interior of the shutter 30. The refrigerant gas in the crank chamber 15 flows into the suction chamber 38 through the relief passage 46, the relief bore 47, and the central bore 27. The relief passage 46, the relief bore 47, and the central bore 27 form a bleeding passage.

As shown in FIG. 1, pressurizing passages 48, 49, which connect the discharge chamber 39 to the crank chamber 15 extend through the cylinder block 11 and the rear housing 14. A control valve 60 is installed in the rear housing 14 between the pressurizing passages 48 and 49.

A first intake passage 51, which does not intersect with the pressurizing passages 48, 49, extends through the rear housing 14 to connect the suction chamber 38 to the control valve 60. An electromagnetic valve 73 connects the discharge chamber 39 to the control valve 60 through a second intake passage 52. The electromagnetic valve 73 selectively connects and disconnects the discharge chamber 39 and the control valve 60.

After the refrigerant gas is compressed to a discharge pressure in each cylinder bore 11*a* and sent into the discharge chamber 39, the refrigerant gas is sent toward an external refrigerant circuit 54 through a gas outlet 53. The external refrigerant circuit 54 includes a condenser 55, an expansion valve 56, and an evaporator 57. The refrigerant gas circulates through the external refrigerant circuit 54 before re-entering the compressor 10 through the suction passage 28. The external refrigerant circuit 54, together with the compressor 10, forms a refrigerant circuit in an automotive air conditioning system.

Figure 2:
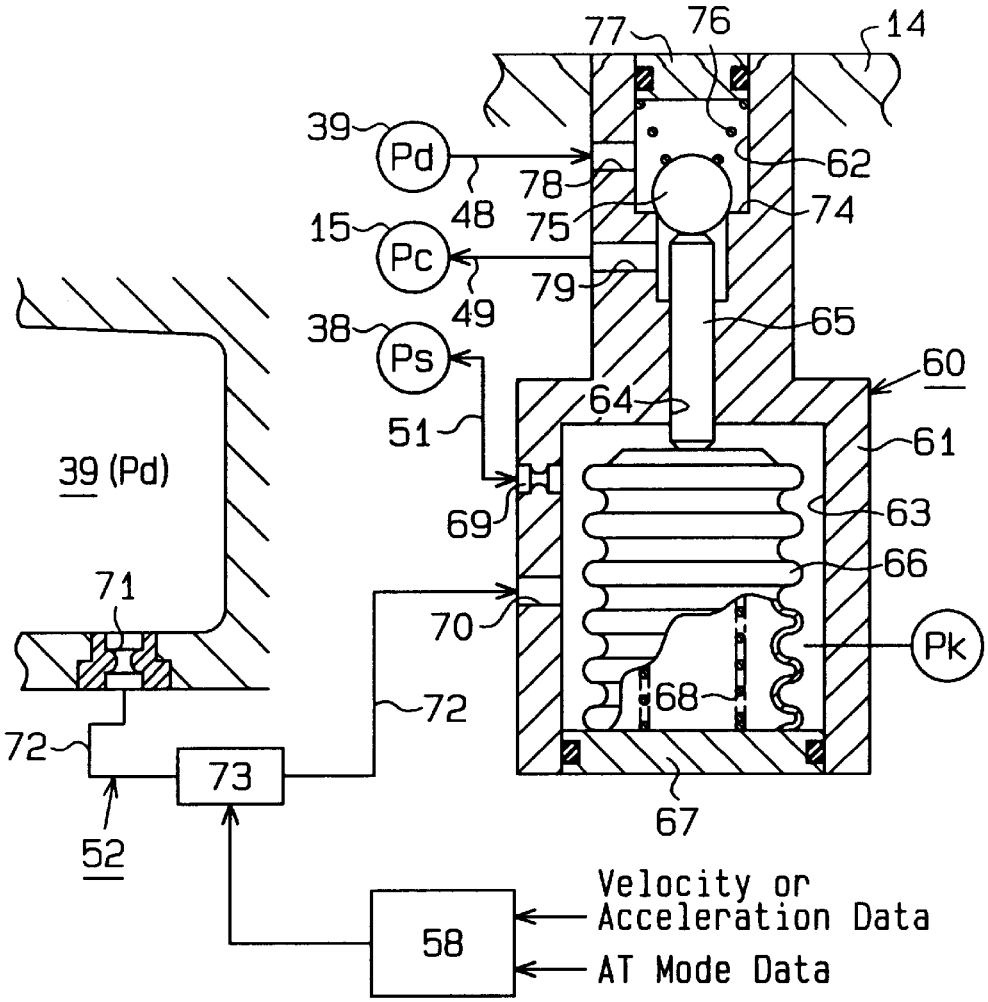
FIG. 2 is a schematic enlarged cross-sectional view showing a control valve employed in the compressor of FIG. 1.

The structure of the control valve 60 will now be described in detail. As shown in FIG. 2, the control valve 60 has a valve housing 61. The valve housing 61 accommodates a valve chamber 62 and a pressure chamber 63. A guide bore 64 extends between the valve chamber 62 and the pressure chamber 63. A rod 65 is slidably arranged in the guide bore 64.

The pressure chamber 63 is located at the lower portion of the valve housing 61, as viewed in FIG. 2. The pressure chamber 63 is defined by the inner wall of the valve housing 61 and a lower cap 67. A bellows 66 is accommodated in the pressure chamber 63. The lower end of the bellows 66 is fixed to the lower cap 67. The interior of the bellows 66 is under vacuum, or is de-pressurized to an extremely low pressure. A spring 68 is arranged in the bellows 66. The spring 68 urges the top of the bellows 66 toward the rod 65. This keeps the top surface of the bellows 66 in contact with the lower end of the rod 65.

A fixed throttle 69 and a port 70 extend through the valve housing wall, which defines the pressure chamber 63. The pressure chamber 63 is connected to the first intake passage 51 through the fixed throttle 69. The refrigerant gas in the suction chamber 38 flows into the pressure chamber 63 through the fixed throttle 69 such that the pressure of the suction chamber (suction pressure Ps) is applied to the bellows 66. The control valve 60 detects and controls the pressure of the suction chamber 38, which is connected to the pressure chamber 63. The discharge chamber 39, or discharge pressure region, is connected to the second intake passage 52 through the port 70. The second intake passage 52 includes a fixed throttle 71, which is arranged in the wall of the rear housing 14, a passage 72, which connects the fixed throttle 71 to the port 70, and the electromagnetic valve 73.

The electromagnetic valve 73 is controlled by a controller 58. The controller 58 stops applying voltage to the electromagnetic valve 73 to cause the valve 73 to open the second intake passage 52. This permits the high-pressure refrigerant gas in the discharge chamber 39 to flow into the pressure chamber 63 through the second intake passage 52. The controller 58 applies voltage to the electromagnetic valve 73 to close the second intake passage 52 with the valve 73. This blocks the flow of high-pressure refrigerant gas from the discharge chamber 39 to the pressure chamber 63. The electromagnetic valve 73 is normally opened. The controller 58 may be part of a control unit of the automotive air conditioning system. Alternatively, the controller 58 may be an electronic control unit (ECU) of the engine 20 that includes a program, executed in an interrupting manner, for controlling the electromagnetic valve 73. The controller 58 controls the electromagnetic valve 73 based on data sent from various sensors and switches (not shown).

The valve chamber 62 is located at the upper portion of the valve housing 61, as viewed in FIG. 2. The top of the valve chamber 62 is sealed by an upper cap 77. A spherical valve body 75 is arranged in the valve chamber 62. A valve seat 74 is defined in the valve chamber 62. The valve seat 74 and the valve body 75 divide the valve chamber 62 into an upper region and a lower region. The upper and lower regions are completely disconnected from each other when the valve body 75 contacts the valve seat 74.

A spring 76 is arranged in the upper region. The spring 76 has an upper end engaging the upper cap 77 and a lower end engaging the valve body 75. The spring 76 forces the valve body 75 toward the valve seat 74. The upper end of the rod 65 is located in the lower region of the valve chamber 62.

The valve housing 61 has a first port 78, which leads into the upper region of the valve chamber 62, and a second port 79, which leads into the lower region of the valve chamber 62. The upper region of the valve chamber 62 is connected to the discharge chamber 39 through the first port 78 and the pressurizing passage 48. The lower region of the valve chamber 62 is connected to the crank chamber 15 through the second port 79 and the pressurizing passage 49.

When the valve body 75 contacts the valve seat 74 and disconnects the pressurizing passages 48, 49 from each other, the flow of refrigerant gas through the pressurizing passages 48, 49 from the discharge chamber 39 to the crank chamber 15 is stopped. When the bellows expands against the force of the spring 76 and moves the valve body 75 with the rod 65, the valve body 75 moves away from the valve seat 74. In this state, the pressurizing passages 48, 49 are connected to one another, which permits the flow of refrigerant gas from the discharge chamber 39 to the crank chamber 15 through the pressurizing passages 48, 49.

The operation of the control valve 60 will now be described. The pressure in the suction chamber 38 (suction pressure Ps) is applied to the pressure chamber 63 through the fixed throttle 69. Thus, when the suction pressure Ps fluctuates, the pressure Pk of the pressure chamber 63 fluctuates. The length of the bellows 66 changes in accordance with the pressure Pk of the pressure chamber 63. For example, the bellows 66 contracts if pressure Pk is higher than a predetermined threshold value and expands if pressure Pk is lower than the threshold value. The deformation of the bellows 66 is transmitted to the valve body 75 through the rod 65. Therefore, the position, or opening size, of the control valve 60 is determined by the pressure Pk of the pressure chamber 63. Changes in the position of the control valve 60 alter the inclination of the swash plate 23. In that sense, the operating principle of the control valve 60 is the same as a typical prior art self-controlled control valve.

In a typical self-controlled valve, the valve body moves away from the valve seat when the suction pressure Ps reaches a predetermined threshold value Pset. The threshold value Pset is determined solely by the force of the spring 68. Thus, the threshold value Pset cannot be varied when the compressor 10 is operating. However, in the control valve 60 of the first embodiment, the high-pressure refrigerant gas in the discharge chamber 39 is selectively drawn into the pressure chamber 63. This varies the threshold value Pset of the suction pressure when the compressor 10 is operating.

The threshold value Pset of the suction pressure is varied as described below. The pressure Pk of the pressure chamber 63 is equal to the suction pressure Ps when the electromagnetic valve 73 is closed. In this state, a first threshold value Pset1 is determined by the force of the spring 68. In the first embodiment, the first threshold value Pset1 is the initial threshold value Pset.

The high-pressure refrigerant gas in the discharge chamber 39 flows into the pressure chamber 63 when the electromagnetic valve 73 is opened. Thus, the pressure Pk of the pressure chamber 63 may reach the first threshold value Pset1 even if the pressure Ps of the suction chamber 38 is less than the first threshold value Pset1. In other words, when the electromagnetic valve 73 is opened, the suction pressure threshold value Pset decreases from the initial first threshold value Pset1 to a second threshold value Pset2. That is, the threshold value Pset of the control valve 60 decreases when the discharge chamber 39 is connected to the pressure chamber 63.

Figure 3:
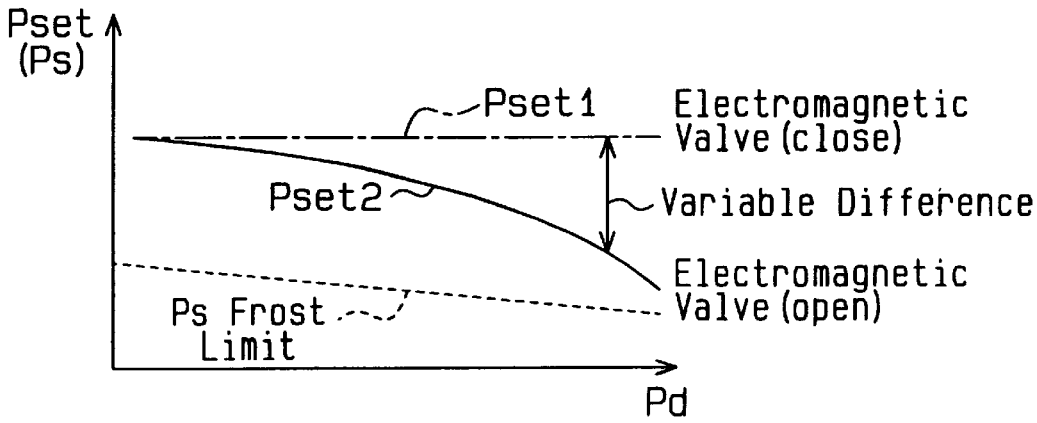
FIG. 3 is a graph showing the characteristics of the suction pressure threshold value in the compressor of FIG. 1.

The graph shown in FIG. 3 indicates the relationship between the pressure Pd of the discharge chamber 39 and the threshold value Pset. The horizontal dashed line shows the relationship of the initial threshold value Pset1 to the discharge pressure Pd. The solid line shows the relationship between the second threshold value Pset2 and the discharge pressure. The sloping dashed line is plotted along the minimum values of the suction pressure Ps that prevents the formation of frost. When the electromagnetic valve 73 is opened, the force of the spring 69 is chosen such that the difference between the second threshold value Pset2 and the frost limit value decreases as the discharge pressure Pd increases. When the electromagnetic valve 73 is closed, the force of the spring 69 is chosen such that the difference between the first threshold value Pset1 and the frost limit value increases as the discharge pressure Pd increases.

The control valve 60 is operated as described below in a manner independent of the operation of the electromagnetic valve 73.

The suction pressure Ps is high when there is a strong demand for cooling the passenger compartment. The bellows 66 contracts when the suction pressure Ps exceeds the threshold value Pset. Contraction of the bellows 66 causes the force of the spring 76 to move the valve body 75 downward until the valve body 75 contacts the valve seat 74. Contact between the valve body 75 and the valve seat 74 disconnects the discharge chamber 39 from the crank chamber and stops the flow of high-pressure refrigerant gas from the discharge chamber 39 to the crank chamber 15. In this state, the refrigerant gas in the crank chamber 15 gradually flows into the suction pressure region (the central bore 27, the suction chamber 38, and the suction passage 28) through the bleeding passage. This gradually decreases the pressure Pc of the crank chamber 15. A decrease in the pressure Pc reduces the back pressure applied to the pistons 36. When the back pressure applied to the pistons 36 decreases, the inclination of the swash plate 23 increases, which lengthens the stroke of the pistons 36. This increases the displacement of the compressor 10.

The suction pressure Ps is low when the demand for cooling the passenger compartment is small. The bellows 66 expands when the suction pressure Ps falls below the threshold value Pset. This moves the valve body 75 away from the valve seat 74 against the force of the spring 76 and connects the discharge chamber 39 to the crank chamber 15. Thus, the high-pressure refrigerant gas in the discharge chamber 39 flows into the crank chamber 15. In this state, the refrigerant gas in the crank chamber 15 gradually flows into the suction pressure region (the central bore 27, the suction chamber 38, and the suction passage 28) through the bleeding passage. However, the fixed throttle 47 restricts the flow rate of the refrigerant gas. Hence, the pressure Pc of the crank chamber 15 increases. An increase in the pressure Pc increases the back pressure applied to the pistons 36. When the back pressure applied to the pistons 36 increases, the inclination of the swash plate 23 decreases, which shortens the stroke of the pistons 36. This decreases the displacement of the compressor 10.

When the swash plate 23 moves toward the minimum inclination position, the shutter 30 moves rearward until its shutting surface 34 comes into contact with the positioning surface 29. As a result, the flow of refrigerant gas through the suction passage 28 from the external refrigerant circuit 54 to the suction chamber 38 is stopped. However, refrigerant gas is continuously discharged from the cylinder bores 11*a* and into the discharge chamber 39. The refrigerant gas in the discharge chamber 39 flows through the pressurizing passages 48, 49, the crank chamber 15, the relief passage 46, and the relief bore 47 and then enters the suction chamber 38. The refrigerant gas in the suction chamber 38 is drawn into the cylinder bores 11*a* and is again discharged into the discharge chamber 39. Accordingly, an internal refrigerant circuit is formed in the compressor even if the suction passage 28 is completely closed by the shutter 30. The difference in pressure at different locations in the internal refrigerant circuit guarantees the circulation of the refrigerant gas. Atomized lubricant is suspended in the refrigerant gas. Therefore, the circulation of the refrigerant gas lubricates the interior of the compressor in a satisfactory manner.

The controller 58 selectively opens and closes the electromagnetic valve 73 to shift the threshold value Pset between Pset1 and Pset2. Data related to the driving conditions of the vehicle are electrically input into the controller 58. Such data includes the vehicle velocity, the accelerating rate, and the driving mode of the automatic transmission (AT). The controller 58 controls the electromagnetic valve 73 based on the input data. For example, if the vehicle is being driven at a substantially constant velocity while a normal mode of the AT is selected, the controller 58 does not feed current to the electromagnetic valve 73, which keeps the electromagnetic valve opened. In this state, the suction pressure threshold value Pset is set at the relatively low second threshold value Pset2. Consequently, the displacement of the compressor 10 readily increases even if the demand for cooling is relatively low (i.e., the suction pressure Ps is relatively low). If the velocity of the vehicle is accelerating while an economy mode of the AT is selected, the controller 58 feeds current to the electromagnetic valve 73 to close the electromagnetic valve 73. In this state, the suction pressure threshold value Pset is set at the relatively high first threshold value Pset1. Thus, a greater cooling demand (suction pressure Ps) is required to increase the displacement of the compressor.

The advantages of the first embodiment will now be described. When the engine load is relatively low, such as when the vehicle is running at a constant velocity, the controller 58 opens the electromagnetic valve 73 and sets the suction pressure threshold value Pset at the relatively low second threshold value Pset2. In this state, the displacement of the compressor increases easily. On the other hand, when the engine load is relatively high, such as during acceleration of the vehicle, the controller 58 closes the electromagnetic valve 73 and sets the suction pressure threshold value Pset at the relatively high first threshold value Pset1. In this state, a greater demand for cooling is required to increase the displacement of the compressor 10. This reduces the time during which a large load is applied to the engine 20 by the compressor 10. Accordingly, the displacement of the compressor is varied by changing the threshold value Pset of the electromagnetic valve 73 in accordance with the operating conditions of the vehicle and the engine 20.

The control valve 60 of the first embodiment is obtained merely by adding the port 70, through which high-pressure refrigerant gas is selectively drawn, to the prior art self-controlled valve. Since this eliminates the need for a large electromagnetic actuator, the control valve 60 of the first embodiment is compact and relatively inexpensive. Furthermore, since an electromagnetic actuator need not be connected to the compressor 10, the installation of the control valve 60 is relatively simple.

Although the electromagnetic valve 73 requires the intake passage 52, which includes the passage 72, the cross-sectional area of the intake passage 52 is small. Thus, the electromagnetic valve 73 may be a small one that consumes little power. Furthermore, the fixed throttle 69 arranged in the first intake passage 51, which connects the pressure chamber 63 and the suction chamber 38, decreases the amount of refrigerant gas that flows out of the pressure chamber 63 when the electromagnetic valve 73 is opened. This is another factor that permits the employment of a more compact electromagnetic valve 73.

The characteristics of the two threshold values Pset1, Pset2, that is, the inclination of the two curves Pset1, Pset2 shown in the graph of FIG. 3, is correlated with the inner diameter D1 of the fixed throttle 71 and the inner diameter D2 of the fixed throttle 69. Based on the experience of the inventors, it is believed that the inclination of the Pset1 and Pset2 curves increase as the inner diameter D2 of the fixed throttle 69 increases, or as the leakage of refrigerant gas from the pressure chamber 63 increases.

In an air conditioning system employing a compressor, pressure loss normally occurs in accordance with the length of the piping between the outlet of the evaporator 57 and the inlet of the compressor 10. Thus, an air conditioning system employing a compressor that incorporates a prior art self-controlled control valve must have the suction pressure threshold value Pset set differently for each type of vehicle in accordance with the length of the piping. More specifically, the force of the spring 68 must be changed for each type of vehicle. However, in the first embodiment, the threshold value Pset is shifted between at least the first and second threshold values Pset1, Pset2 by adjusting the amount of the high-pressure refrigerant gas drawn into the pressure chamber 63. This simplifies the structure of the air conditioning system in comparison to that of the prior art.

Second Embodiment

Figure 4:
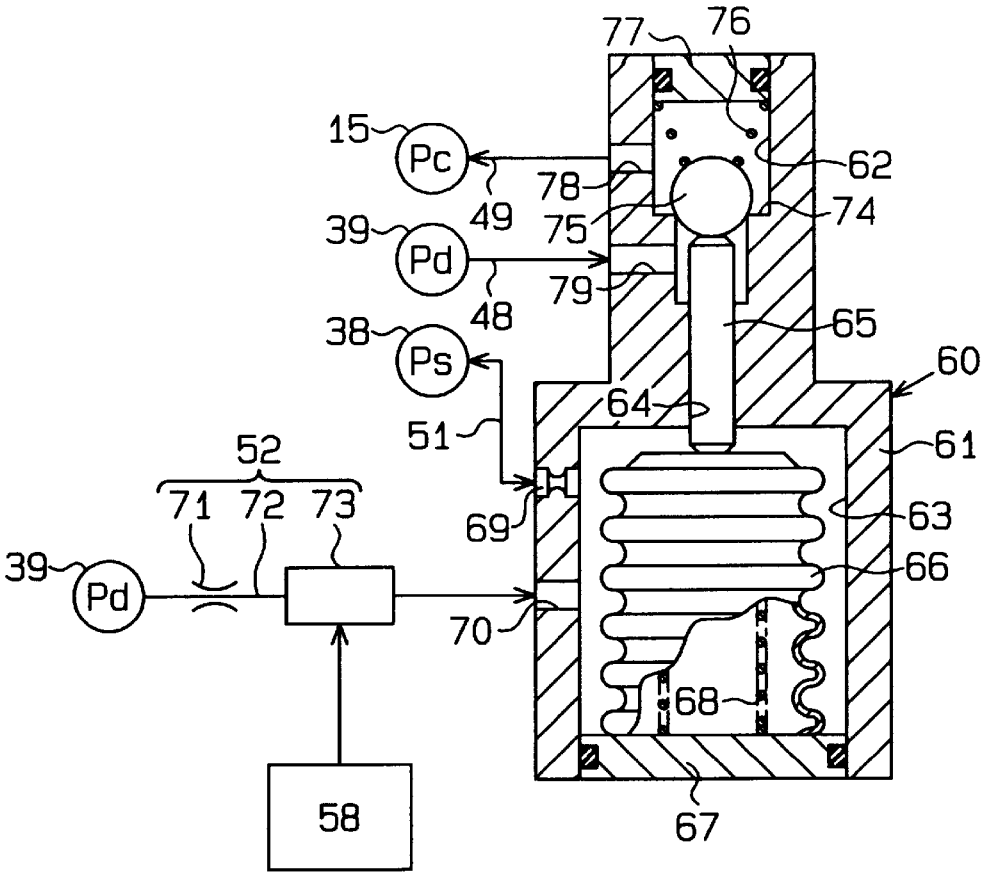
FIG. 4 is a cross-sectional view combined with a block diagram showing a control valve employed in a compressor according to a second embodiment of the present invention.

As shown in FIG. 4, the first port 78 extending from the upper region of the valve chamber 62 is connected to the crank chamber 15 through the pressurizing passage 49. The second port 79 extending from the lower region of the valve chamber 62 is connected to the discharge chamber 39 through the pressurizing passage 48. Thus, refrigerant gas pressurized to the discharge pressure Pd is constantly sent into the lower region of the valve chamber 62. The refrigerant gas in the lower region of the valve chamber 62 has a tendency to flow toward the upper region of the valve chamber 62. In other words, the flow direction of refrigerant gas in the valve chamber 62 is the same as the direction in which the valve body 75 moves away from the valve seat 74. This direction, upward in FIG. 4, is the same as the urging direction of the spring 68. Thus, the differential pressure produced between the discharge pressure Pd, which acts on the lower side of the valve body 75, and the pressure Pc, which acts on the upper side of the valve body 75, is added to the force of the spring 68. As a result, in the control valve 60 of the second embodiment, the first threshold value Pset1 curve, which represents the characteristics of the control valve 60 when the electromagnetic valve 73 is closed, is inclined upwardly to the right, as shown in FIG. 5.

Figure 5:
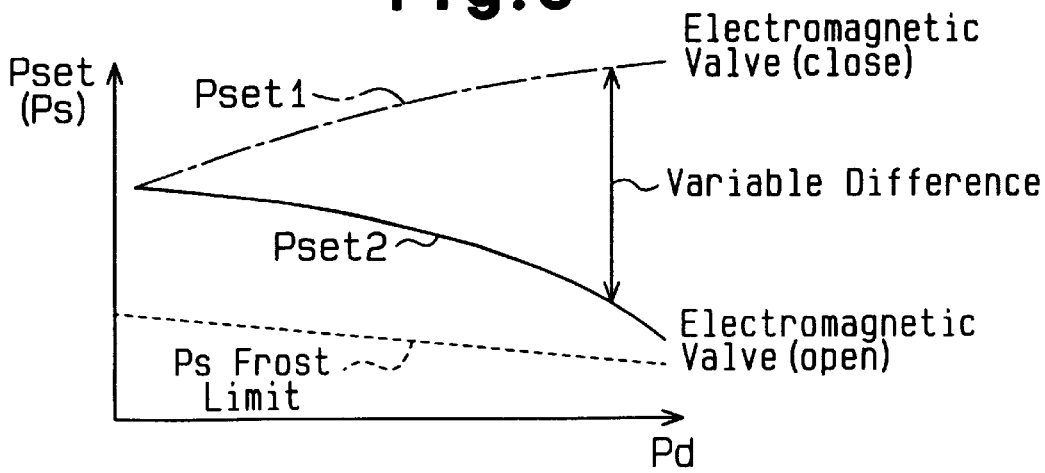
FIG. 5 is a graph showing the characteristics of the suction pressure threshold value in the compressor of FIG. 4.

Since the first threshold value Pset1 curve is inclined upwardly to the right, the difference between the first threshold value Pset1 (initial value) and the second threshold value Pset2 in the second embodiment, as shown in FIG. 5, is greater than the difference between the first threshold value Pset1 and the second threshold value Pset2 in the first embodiment, as shown in FIG. 3. Therefore, in comparison to the control valve 60 of the first embodiment, the control valve 60 of the second embodiment varies the suction pressure threshold value Pset by a greater degree when the electromagnetic valve 73 is switched. Accordingly, the compressor 10 incorporating the control valve 60 of the second embodiment can be used with a larger number of vehicle types.

Third Embodiment

Figure 6:
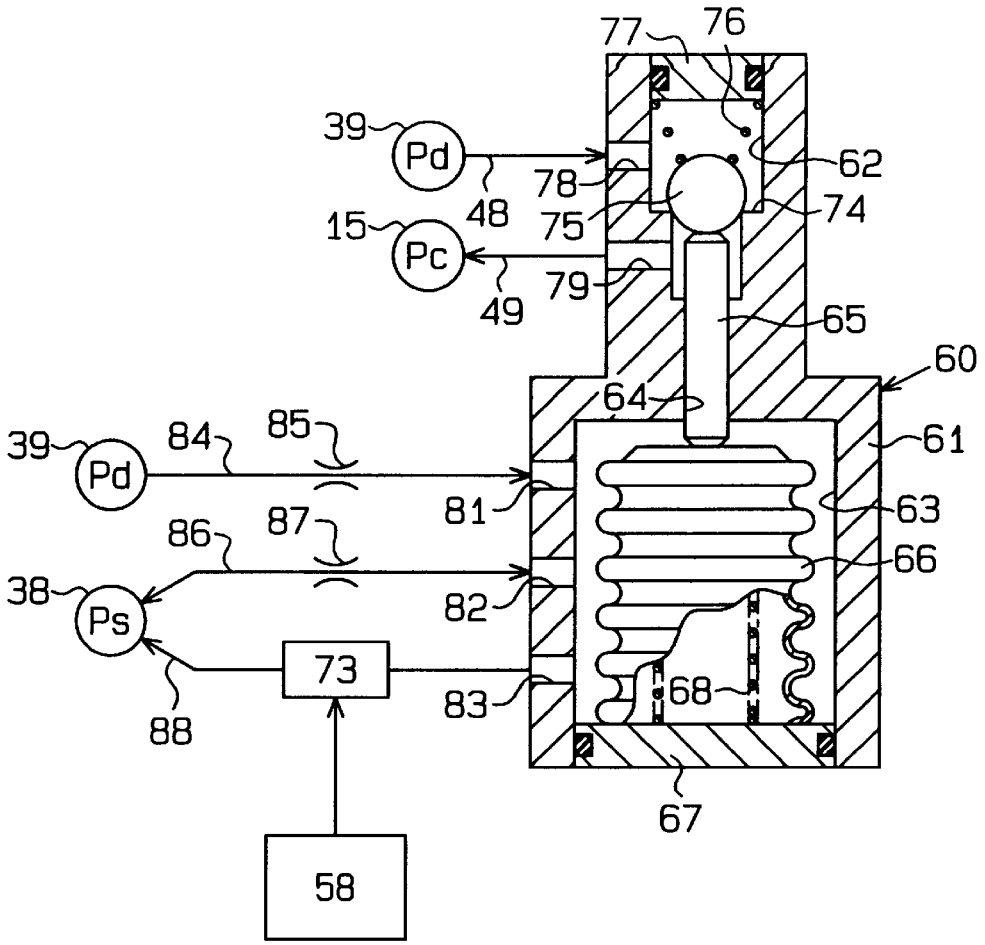
FIG. 6 is a schematic cross-sectional view showing a control valve employed in a compressor according to a third embodiment of the present invention.

As shown in FIG. 6, three ports 81, 82, 83 extend through the wall of the pressure detecting chamber 63. The first port 81 is connected to the discharge chamber 39 through a passage 84. A fixed throttle 85 is arranged in the passage 84. The second port 82 is connected to the suction chamber 38 through a passage 86. A fixed throttle 87 is arranged in the passage 86. The third port 83 is connected to the suction chamber 38 through a passage 88. An electromagnetic valve 73 is arranged in the passage 88. The controller 58 controls the electromagnetic valve 73 to selectively open and close the passage 88.

When the passage 88 is closed by the electromagnetic valve 73, refrigerant gas pressurized to pressure Pd flows into the pressure chamber 63 from the discharge chamber 39. Some of the refrigerant gas flows into the suction chamber 38 through the passage 86, throttled by the fixed throttle 87. Thus, the pressure Pk of the pressure chamber 63 approaches the pressure of the discharge chamber 39. On the other hand, opening the passage 88 with the electromagnetic valve 73 has the same effect as increasing the inner diameter of the fixed throttle 87. Therefore, although relatively high pressure refrigerant gas flows into the pressure chamber 63 from the discharge chamber 39, the refrigerant gas flows out of the pressure chamber 63 and into the suction chamber 38 through the passages 86, 88. Consequently, the pressure Pk in the pressure chamber 63 approaches the pressure Ps of the suction chamber 38. Closing the passage 88 with the electromagnetic valve 73 in FIG. 6 is substantially equivalent to opening the electromagnetic valve 73 in FIG. 2. Opening the passage 88 with the electromagnetic valve 73 in FIG. 6 is substantially equivalent to closing the electromagnetic valve 73 in FIG. 2.

Figure 7:
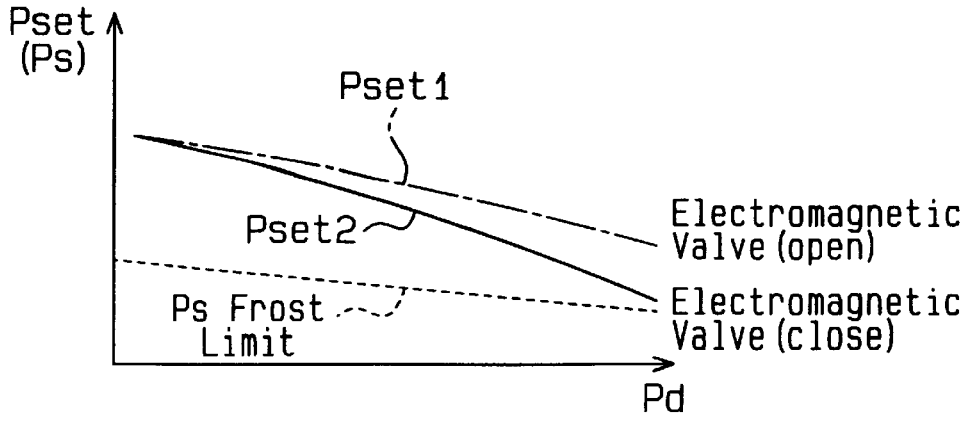
FIG. 7 is a graph showing the characteristics of the suction pressure threshold value in the compressor of FIG. 6.

The characteristics of the suction pressure threshold value Pset in the third embodiment are shown in the graph of FIG. 7. When the electromagnetic valve 73 is closed, the threshold value Pset is set at the second threshold value Pset2. When the electromagnetic valve 73 is opened, the threshold value Pset is set at the first threshold value Pset1. The second threshold value Pset2 is set such that it is as close as possible to the frost limit curve.

The refrigerant gas flowing through the electromagnetic valve 73 employed in the first embodiment is pressurized to a value substantially the same as the discharge pressure Pd, whereas the refrigerant flowing through the electromagnetic valve 73 employed in the third embodiment is only pressurized to a value substantially the same as the suction pressure Ps. Thus, the electromagnetic valve 73 of the third embodiment is more compact than the electromagnetic valve 73 of the first embodiment.

The compressor 10 incorporating the control valve 60 shown in FIG. 6 has the same advantages as the first embodiment.

Fourth Embodiment

Figure 8:
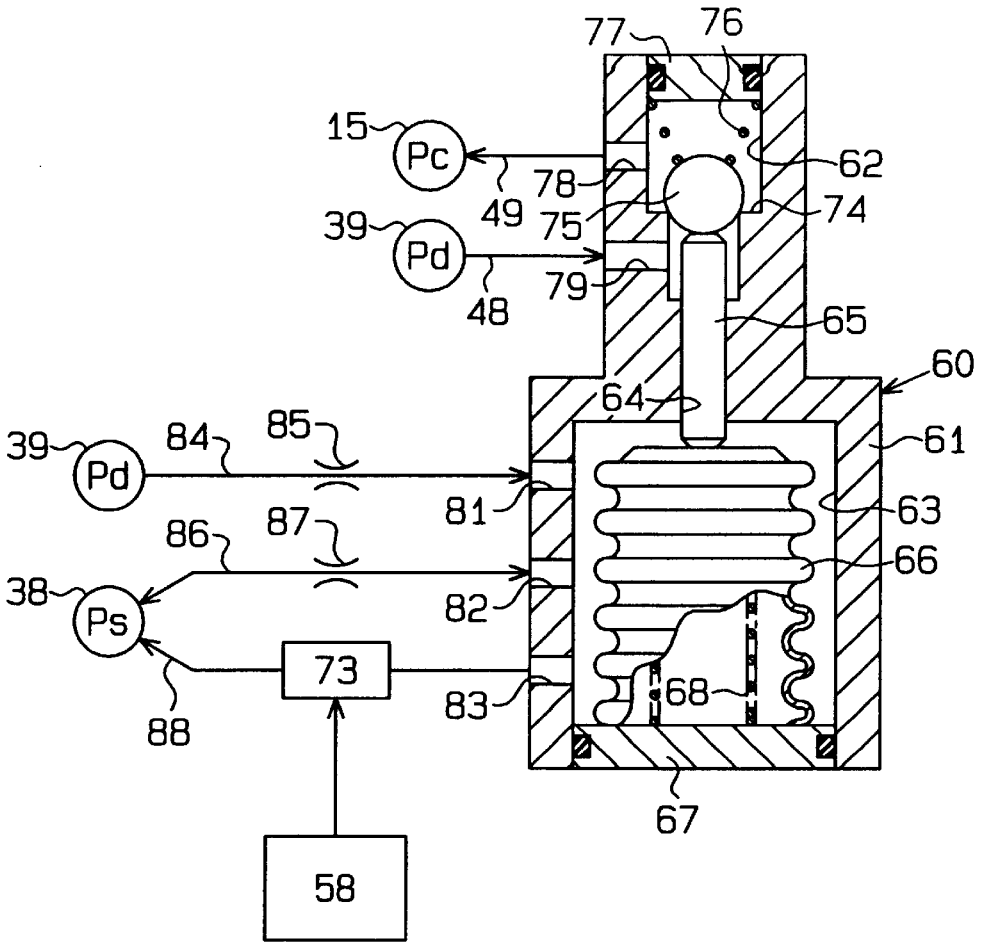
FIG. 8 is a schematic cross-sectional view showing a control valve employed in a compressor according to a fourth embodiment of the present invention.

As shown in FIG. 8, the first port 78 extending from the upper region of the valve chamber 62 is connected to the crank chamber 15 through the pressurizing passage 49. The second port 79 extending from the lower region of the valve chamber 62 is connected to the discharge chamber 39 through the pressurizing passage 48. Thus, relatively high pressure refrigerant gas from the discharge chamber 39 is constantly sent into the lower region of the valve chamber 62. The refrigerant gas in the lower region of the valve chamber 62 has a tendency to flow toward the upper region of the valve chamber 62. In other words, the flow direction of refrigerant gas in the valve chamber 62 is the same as the urging direction of the spring 68. Thus, the differential pressure produced between the discharge pressure Pd, which acts on the lower side of the valve body 75, and the crank chamber pressure Pc, which acts on the upper side of the valve body 75, is added to the force of the spring 68.

Figure 9:
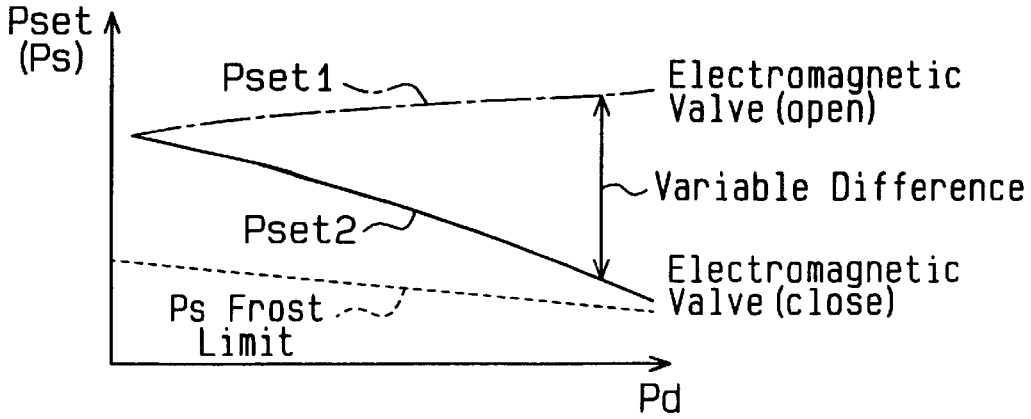
FIG. 9 is a graph showing the characteristics of the suction pressure threshold value in the compressor of FIG. 8.

The characteristics of the intake pressure threshold value Pset in the control valve 60 of the fourth embodiment are shown in FIG. 9. The first threshold value Pset1 curve, which is selected when the electromagnetic valve 73 is opened, is inclined more upwardly to the right in comparison to the first threshold value Pset1 curve of the third embodiment shown in FIG. 7. Accordingly, the difference between the first threshold value Pset1 and the second threshold value Pset2 in the fourth embodiment, as shown in FIG. 9, is greater than that of the third embodiment, as shown in FIG. 7. Therefore, in comparison to the control valve 60 of the third embodiment, the control valve 60 of the fourth embodiment varies the suction pressure threshold value Pset by a greater degree when the electromagnetic valve 73 is switched. Accordingly, the compressor 10 incorporating the control valve 60 of the fourth embodiment can be applied to a larger number of vehicle types.

Fifth Embodiment

Figure 10:
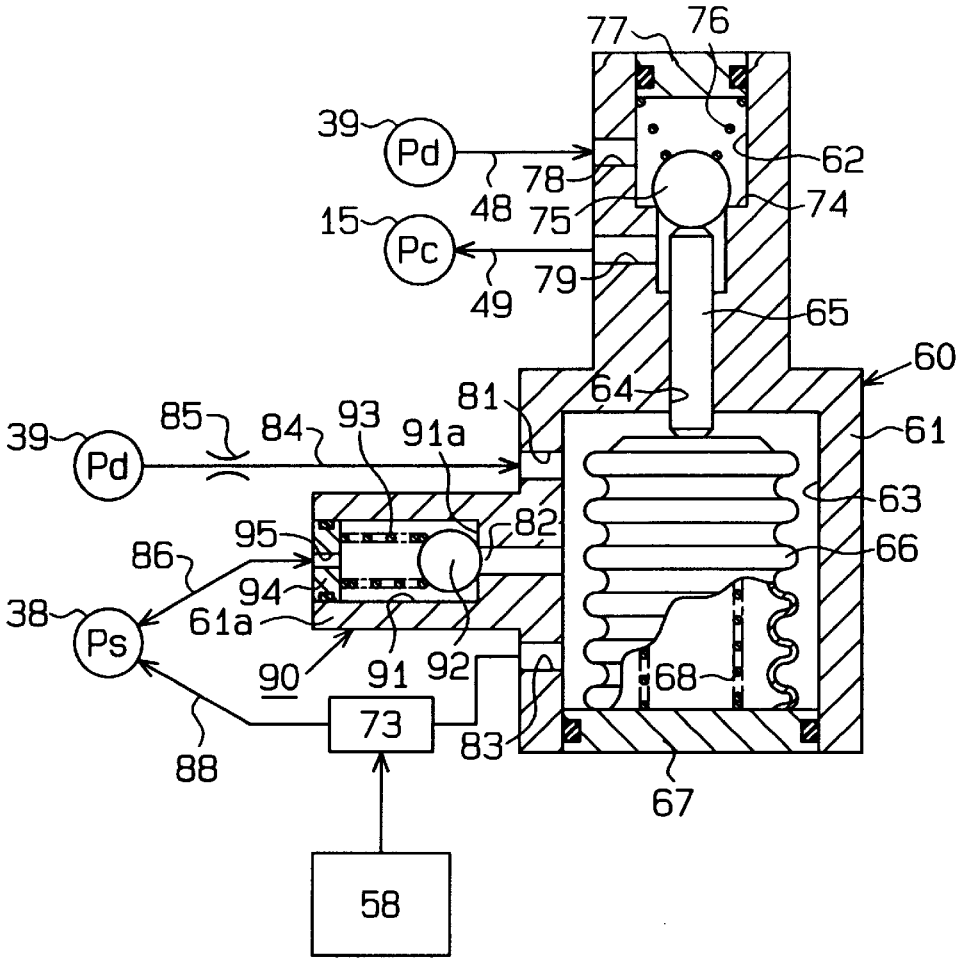
FIG. 10 is a schematic cross-sectional view showing a control valve employed in a compressor according to a fifth embodiment of the present invention.

As shown in FIG. 10, the control valve 60 of the fifth embodiment is similar to that of the third embodiment (FIG. 6). A boss 61*a* extends from the valve housing 61 of the control valve 60. The boss 61*a* houses a differential pressure valve mechanism 90. The differential valve mechanism 90 includes a valve chamber 91, a spherical valve body 92 accommodated in the valve chamber 91, and a spring 93. The valve chamber 91 has an opening that is sealed by a cap 94. One end of the spring 93 is fixed to the cap 94, while the other end is fixed to the valve body 92. The spring 93 urges the valve body 92 toward the valve seat 91*a*. When the valve body 92 comes into contact with the valve seat 91*a*, the second port 82 is completely closed in the side of the valve chamber 91. A bore 95 extends through the center of the cap 94. The valve sensing chamber 63 is connected to the suction chamber 38 through the differential pressure valve mechanism 90.

The valve chamber 91 is always connected with the suction chamber 38. Thus, the pressure of the valve chamber 91 is equal to the suction pressure Ps. The pressure Pk in the pressure chamber 63 acts on the side of the valve body 82 that is closer to the second port 82. Relatively high pressure refrigerant gas is continuously sent into the pressure chamber 63 from the discharge chamber 39 through the fixed throttle 85. Accordingly, the pressure Pk of the pressure chamber 63, which is applied to the valve body 92, acts in a direction causing the valve body 92 to open the second port 82. The position of the valve body 92 in the valve chamber 91 is determined by the force of the spring 93 and the difference between the suction pressure Ps and the pressure Pk of the pressure chamber 63. For example, if the pressure Pk of the pressure chamber 63 is higher than a predetermined value, the valve body 92 moves away from the valve seat 91*a* and opens the second port 82. This gradually decreases the value of the chamber pressure Pk. If the pressure Pk of the pressure chamber 63 falls below the predetermined value, the valve body 92 contacts the valve seat 91*a* and closes the second port 82. This gradually increases the value of the pressure Pk. In this manner, the differential valve mechanism 90 automatically changes the size of its opening such that the difference between the suction pressure Ps and the pressure Pk of the pressure chamber 63 (Pk−Ps) is maintained at a substantially constant value.

Like the third embodiment, the electromagnetic valve 73 is normally closed in the control valve 60 of the fifth embodiment. In this state, relatively high pressure refrigerant gas flows into the pressure chamber 63 from the discharge chamber 39. The pressure Pk of the pressure chamber 63 is determined by the differential pressure valve 90. Closing the electromagnetic valve 73 in the fifth embodiment of FIG. 10 is like closing the electromagnetic valve 73 in the third embodiment illustrated in FIG. 6. When the electromagnetic valve 73 is opened, the pressure Pk of the pressure chamber 63 approaches the pressure Ps of the suction chamber 38, since the pressure chamber 63 and the suction chamber 38 are connected to each other through the passage 88.

Figure 11:
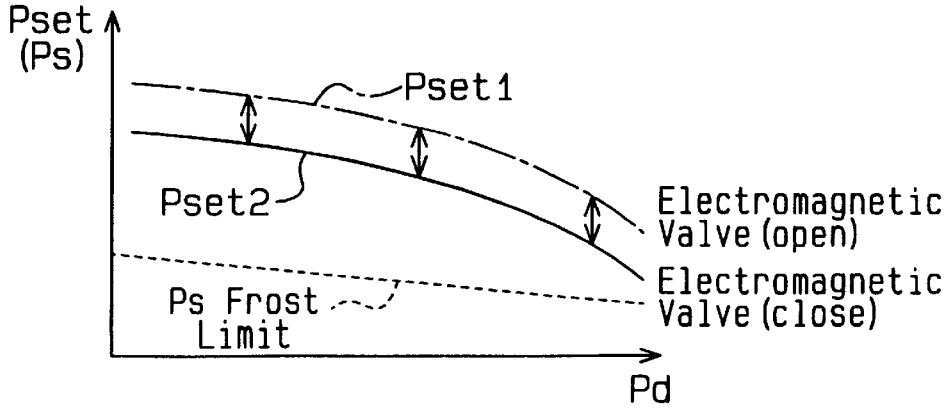
FIG. 11 is a graph showing the characteristics of the suction pressure threshold value in the compressor of FIG. 10.

The characteristics of the suction pressure threshold value Pset in the fifth embodiment are shown in the graph of FIG. 11. When the electromagnetic valve 73 is closed, the threshold value Pset of the suction pressure Ps is set at the second threshold value Pset2. When the electromagnetic valve 73 is opened, the threshold value Pset is changed from the second threshold value Pset2 to the first threshold value Pset1. The second threshold value Pset2 is set such that it is as close as possible to the frost limit curve.

As shown in the graph of FIG. 11, the first threshold value Pset1 curve is substantially parallel to the second threshold value Pset2 curve. This differs from the first to fourth embodiments (FIGS. 3, 5, 7, and 9). In the first to fourth embodiments, the difference between the first threshold value Pset1 curve and the second threshold value Pset2 decreases as the discharge pressure Pd decreases. Accordingly, the control valve 60 of the fifth embodiment is advantageous if the suction pressure threshold value Pset must be varied by switching the valve 73 when the discharge pressure Pd is relatively low.

In the fifth embodiment, the differential pressure valve mechanism 90 maintains the same difference between the pressure Pk of the pressure chamber 63 and the suction pressure Ps. Thus, the difference between the first threshold value Pset1 and the second threshold value Pset2 is kept substantially constant regardless of the compressor displacement. As a result, the compressor displacement is variably controlled in accordance with the conditions of the vehicle and the engine 20 by shifting the suction pressure threshold value Pset even if the displacement is small. This decreases the load applied to the engine 20 and prevents the engine 20 from stalling, for example, when the engine 20 is idling (a state in which the engine speed is low and it is preferable that the compressor displacement is small) or when the vehicle is stopped suddenly.

Sixth Embodiment

Figure 12:
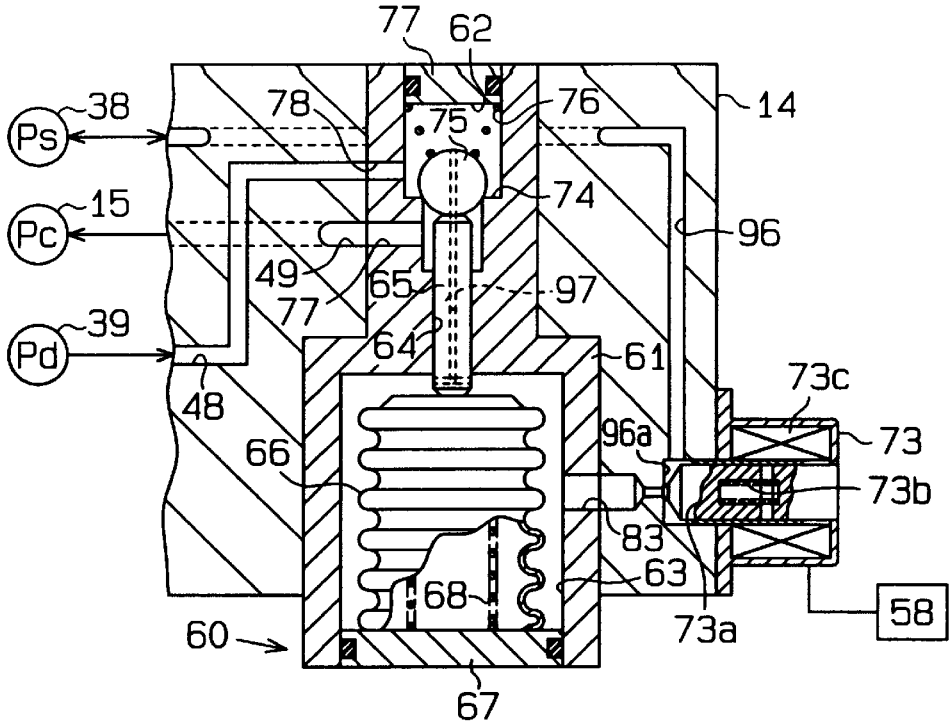
FIG. 12 is a schematic cross-sectional view showing a control valve employed in a compressor according to a sixth embodiment of the present invention.

As shown in FIG. 12, in the control valve 60 of the sixth embodiment, the number of ports extending through the valve housing 61 is less than that of the fifth embodiment. A single port 83 extends from the pressure chamber 63. The pressure chamber 63 is connected to the suction chamber 38 solely by passage 96. The valve body 75 is fixed to the upper end of the rod 65. A narrow passage 97 extends through the valve body 75 and the rod 65. The passage 97 connects the upper region of the valve chamber 62 to the pressure chamber 63. Thus, refrigerant gas is continuously sent into the pressure chamber 63 from the discharge chamber 39 through the passage 97. The passage 97 functions as a fixed throttle for restricting the flow of the refrigerant gas from the discharge chamber 39 to the pressure chamber The electromagnetic valve 73 is arranged in the passage 96 at the rear portion of the rear housing 14. The electromagnetic valve 73 includes a valve body 73*a*, a spring 73*b*, and a coil 73*c*. A valve seat 96*a* is formed in the passage 96 to receive the valve body 73*a*. The valve body 73*a* closes the passage 96 when in contact with the valve seat 96*a*. The spring 73*b* urges the valve body 73*a* toward the valve seat 96*a*. Excitation of the coil 73*c* moves the valve body 73*a* away from the valve seat 96*a* against the force of the spring 73*b*. The controller 58 controls the electromagnetic valve 73 to selectively open and close the passage 96 and control the flow of refrigerant gas between the pressure chamber 63 and the suction chamber 38.

The valve body 73*a* moves in accordance with the equilibrium between the force produced by the suction pressure Ps and the spring 73*b* and the force produced by the pressure Pk of the pressure chamber 63, even if the coil 73*c* is not excited. The size of the passage 96 opened by the valve body 73*a* is varied in accordance with the movement of the valve body 73*a*. Thus, the electromagnetic valve 73 functions as a variable throttle and maintains the difference between the suction pressure Ps and the pressure Pk at a substantially constant value. Accordingly, when current is fed to the coil 73*c*, the electromagnetic valve 73 completely opens the passage 96. When the coil 73*c* is de-excited, the electromagnetic valve 73 adjusts the opening size of the passage 96 based on the pressure Pk of the pressure chamber 63 and the suction pressure Ps.

In the sixth embodiment (FIG. 12), the first threshold value Pset1 curve is substantially parallel to the second threshold value Pset2 curve in the same manner as the fifth embodiment (FIG. 11). The difference between the first threshold value Pset1, which is affected by the force of the spring 68, and the frost limit is greater than the difference between the second threshold value Pset2, which is affected by the amount of refrigerant gas drawn into the pressure chamber 63 from the discharge chamber 39, and the frost limit. The second threshold value Pset2 curve approaches the frost limit curve as the discharge pressure Pd increases.

In the sixth embodiment, the electromagnetic valve 73 shifts the threshold value between two values. Furthermore, the passage 97, which extends through the valve body 75 and the rod 65, decreases the number of passages in the compressor 10. This decreases the number of machining processes required during the production of the compressor 10 and reduces the number of seals required to seal spaces between the control valve 60 and such passages. Additionally, since the number of passages are decreased, the rear housing 14 has a smaller size. Thus, the compressor 10 is more compact.

Seventh Embodiment

Figure 13:
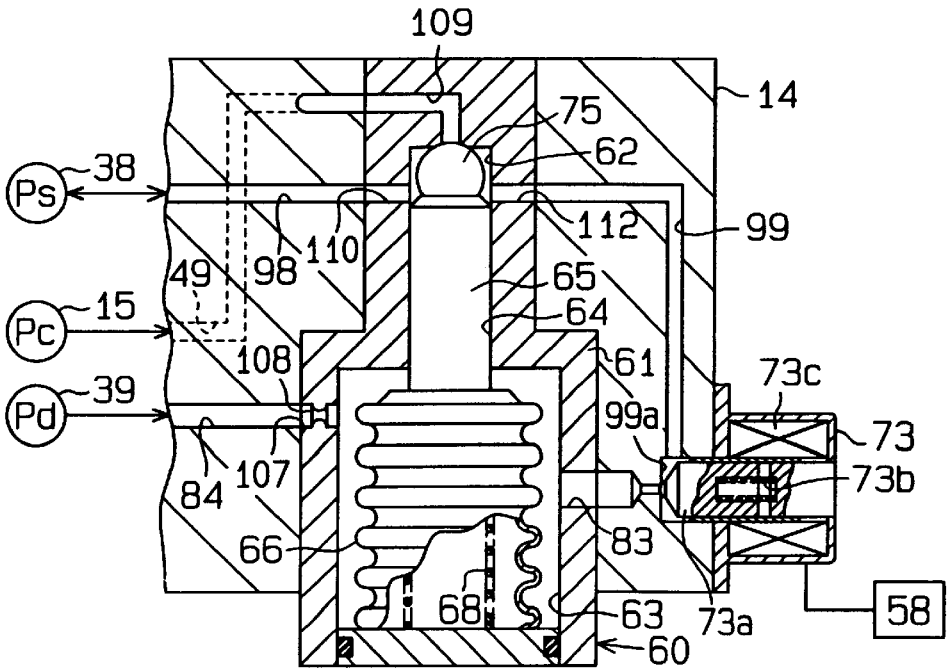
FIG. 13 is a schematic cross-sectional view showing a control valve employed in a compressor according to a seventh embodiment of the present invention.

As shown in FIG. 13, in the same manner as the sixth embodiment, the electromagnetic valve 73 is installed in the rear portion of the rear housing 14. A port 107 extends from the pressure chamber 63. The port 107 is connected to a passage 84, which leads into the discharge chamber 39. A fixed throttle 108 is defined in the port 107. The pressurizing passage 49, which extends from the crank chamber 15, is connected to the valve chamber 62 through a port 109. A passage 98, which extends from the suction chamber 38, is connected to the valve chamber 62 through a port 110. The pressure Ps of the suction chamber 38 is always applied to the valve chamber 62. The valve chamber 62 is connected to a valve sensing chamber 63 by way of a port 112, a passage 99, the electromagnetic valve 73, and the port 83.

The valve chamber 62 houses the valve body 75. The valve body 75 is formed integrally with the rod 65. The spring 68 arranged in the bellows 66 urges the valve body 75 toward the port 109. The valve body 75 and the rod 65 are moved by the deformation of the bellows 66. For example, if the pressure Pk of the pressure chamber 63 is high, the bellows 66 contracts and causes the valve body 75 to open the port 109. If the pressure Pk of the pressure chamber 63 is low, the bellows 66 expands and closes the port 109 with the valve body 75. Accordingly, the suction chamber 38 and the crank chamber 15 are connected and disconnected from each other in accordance with the pressure Pk of the pressure chamber 63.

The electromagnetic valve 73 is arranged in the passage 99. When the valve body 73*a* contacts a valve seat 99*a*, which is formed in the passage 99, the valve body 73*a* closes the passage 99. Like the sixth embodiment, the electromagnetic valve 73 opens the passage 99 when the coil 73 is excited. When the coil 73*c* is de-excited, the electromagnetic valve 73 functions as a variable throttle and maintains the difference between the suction pressure Ps and the pressure Pk of the pressure chamber 63 at a substantially constant value.

The operation of the control valve 60 will now be described. High-pressure refrigerant gas is gradually drawn into the pressure chamber 63 from the discharge chamber 39 through the port 107. Thus, the pressure Pk of the pressure chamber 63 approaches the discharge pressure Pd.

Excitation of the coil 73*a* causes the valve body 73*a* to open the passage 99 and release the high-pressure refrigerant gas from the pressure chamber 63. As a result, the pressure Pk of the pressure chamber 63 decreases to a value slightly higher than the suction pressure Ps. In th is state, the difference between the suction pressure Ps and the pressure Pc of the crank chamber 15 scarcely affects the behavior of the spring 68. Thus, the first threshold value Pset1 curve decreases more gradually than that of the sixth embodiment.

If the coil 73*c* is de-excited and the suction pressure Ps of the suction chamber 38 is high, the electromagnetic valve 73 remains closed until the difference between the pressure Pk of the pressure chamber 63 and the suction pressure Ps of the suction chamber 38 reaches a predetermined value . Therefore, the pressure Pk of the pressure chamber 63 increases. When the pressure Pk of the pressure chamber 63 exceeds a predetermined value P0, the bellows 66 contracts against the force of the spring 68. This causes the valve body 75 to open the port 109 and release the refrigerant gas in the crank chamber 15 into the suction chamber 38 through the valve chamber 62.

If the coil 73*c* is de-excited and the suction pressure Ps of the suction chamber 38 is relatively low, the electromagnetic valve 73 is opened such that the difference between the pressure Pk of the pressure chamber 63 and the suction pressure Ps of the suction chamber 38 becomes equal to a predetermined value. When the pressure Pk of the pressure chamber 63 falls below the predetermined pressure P0, the force of the spring 68 expands the bellows 66. This closes the port 109 with the valve body 75 and stops the flow of refrigerant gas in the valve chamber 62 from the crank chamber 15 to the suction chamber 38.

As described above, the valve body 73*a* throttles the passage 99 and restricts the amount of refrigerant gas released into the suction chamber 38 from the pressure chamber 63 when the coil 73*c* is de-excited. Therefore, the pressure Pk of the pressure chamber 63 is higher than the suction pressure Ps by a predetermined value. Accordingly, in the same manner as the sixth embodiment, the second threshold values Pset2 are lower than the first threshold values Pset1 by a predetermined amount.

The electromagnetic valve 73 automatically adjusts the pressure Pk of the pressure chamber 63 such that the difference between the pressure Pk and the suction pressure Ps remains constant. Further, the controller 58 selectively connects and disconnects the crank chamber 15 and the suction chamber 38 with the electromagnetic valve 73. In other words, the controller 58 shifts the threshold value between the first threshold value Pset1 and the second threshold value Pset2.

In the seventh embodiment, the valve chamber 62 is located between the passages 99, 98 that connect the pressure chamber 63 to the suction chamber 62. This decreases the number of passages extending between the control valve 60 and the discharge chamber 39. Like the sixth embodiment, this decreases the number of machining processes required during the production of the compressor 10 and reduces the number of seals required to seal spaces between the control valve 60 and such passages. Additionally, since the number of passages are decreased, the rear housing 14 has a smaller size. Thus, the compressor 10 is more compact.

Eighth Embodiment

Figure 14:
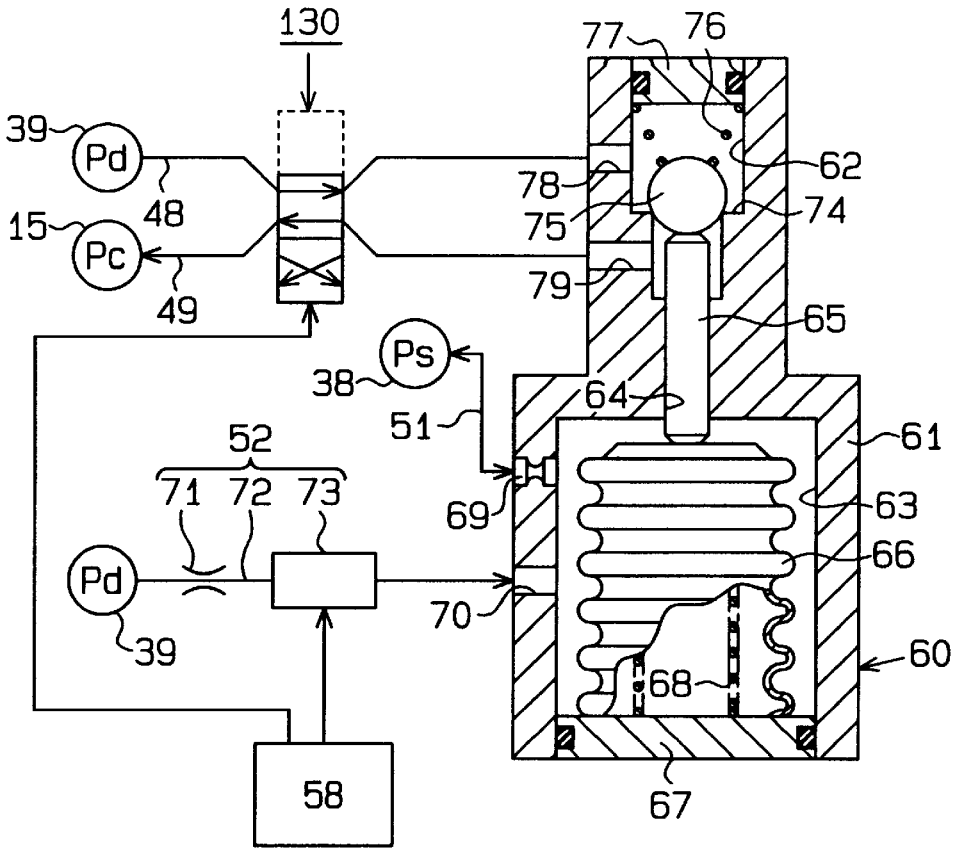
FIG. 14 is a schematic cross-sectional view showing a control valve employed in a compressor according to an eighth embodiment of the present invention.

As shown in FIG. 14, in the control valve 60 of the eighth embodiment, a switching valve 130 is arranged in the pressurizing passages 48, 49. The switching valve 130 is controlled by a controller 58 to switch the connections between the discharge chamber 39, the crank chamber 15, and the valve chamber 62.

FIG. 14 shows the switching valve 130 in a normal position, or first position. In the first position, the discharge chamber 39 is connected to the first port 78, while the second port 79 is connected to the crank chamber 15. When the switching valve 130 is moved to a second position, the discharge chamber 39 is connected to the second port 79, while the first port 78 is connected to the crank chamber 15. Regardless of whether the switching valve 130 is in the first position or the second position, the high-pressure refrigerant gas in the discharge chamber 39 is sent to the crank chamber 15 through the valve chamber 62. However, the flow direction of gas in the valve chamber 62 is reversed by the switching valve 130. That is, if the switching valve 130 is in the first position, the refrigerant gas flows downward in the valve chamber 62, as viewed in FIG. 14. If the switching valve 130 is in the second position, the refrigerant gas flows upward in the valve chamber 62.

Figure 15:
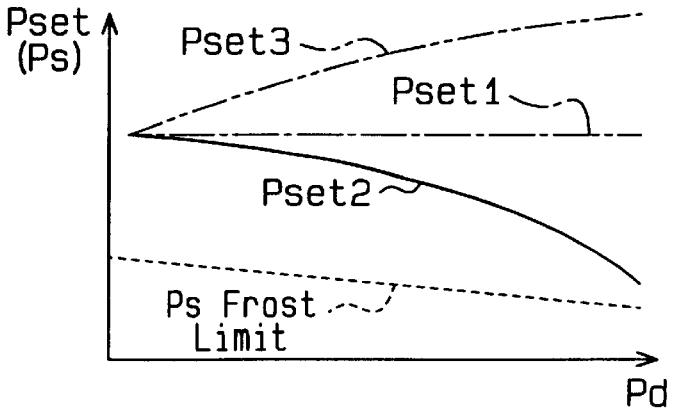
FIG. 15 is a graph showing the characteristics of the suction pressure threshold value in the compressor of FIG. 14.

The control valve 60 functions in the same manner as the control valve 60 shown in FIG. 2 when the switching valve 130 is in the first position. When the switching valve 130 is maintained in the first position, the electromagnetic valve 73 is controlled to shift the suction pressure threshold value Pset between the first threshold value Pset1 and the second threshold value Pset2, as shown in the graph of FIG. 15. The control valve 60 functions in the same manner as the control valve 60 shown in FIG. 4 when the switching valve 130 is in the second position. When the switching valve 130 is maintained in the second position, the electromagnetic valve 73 is controlled to shift the suction pressure threshold value Pset between a third threshold value Pset3 (corresponding to the first threshold value Pset1 in the embodiment illustrated in FIG. 4) and the second threshold value Pset2, as shown in the graph of FIG. 15. Furthermore, when the electromagnetic valve 73 is closed, the switching valve 130 is controlled to shift the suction pressure threshold value Pset between the first threshold value Pset1 and the third threshold value Pset3. Accordingly, the controller 58 controls the electromagnetic valve 73 and the switching valve 130 such that the threshold value Pset is shifted between three values, as shown in FIG. 15.

Ninth Embodiment

Figure 16:
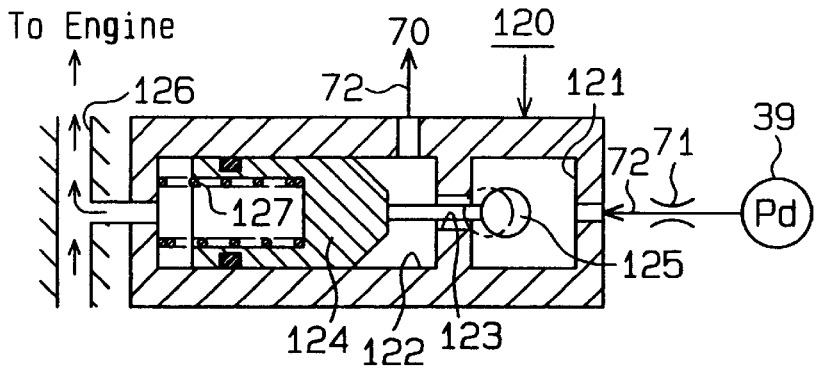
FIG. 16 is a schematic cross-sectional view showing a valve mechanism employed in a compressor according to an ninth embodiment of the present invention.

In a ninth embodiment according to the present invention, the electromagnetic valve 73 employed in the embodiments of FIGS. 2 and 4 may be replaced by a valve mechanism 120 shown in FIG. 16. The valve mechanism 120 has a first chamber 121 and a second chamber 122. The first chamber 121 is connected to the discharge chamber 39 by way of a fixed throttle 71. The first chamber 121 is connected to the second chamber 122 through a communication bore 123. A spherical valve body 125 is accommodated in the first chamber 121. A spool 124 is slidably accommodated in the second chamber 122. The spool 124 divides the second chamber 122 into a right region (rightward of the spool 124) and a left region (leftward of the spool 124). The right region is always connected with the pressure chamber 63 through the port 70. The left region is connected to an intake passage 126, which leads to the engine. A spring 127 is arranged in the left region to urge the spool 124 to the right, as viewed in FIG. 16. A connecting rod is fixed to the right end of the spool 124. The spherical valve body 125 is connected to the spool 124 by the connecting rod. The valve body 125 opens the communication bore 123 when the spool 124 moves toward the right and closes the communication bore 123 when the spool 124 moves toward the left.

When the vehicle is being driven at a constant speed and the engine speed is substantially constant, the valve mechanism 120 of FIG. 16 de-pressurizes the left region of the second chamber 122 due to the vacuum pressure produced by the flow of intake air in the intake passage 126. However, the force of the vacuum pressure is weaker than the force of the spring 127. Thus, the valve body 125 does not close the communication bore 123. When the engine speed increases (e.g., during acceleration of the vehicle) and causes the vacuum pressure to apply a force on the spool 124 that is stronger than the force of the spring 127, the spool 124 moves toward the left and closes the communication bore 123 with the valve body 125. In this state, the flow of refrigerant gas through the passage 72 is stopped. Accordingly, the valve mechanism 120 may be used in lieu of the electromagnetic valve 73 employed in the embodiments of FIGS. 2 and 4 to shift from the second threshold value Pset2 to the first threshold value Pset1 during acceleration of the vehicle.

Tenth Embodiment

Figure 17:
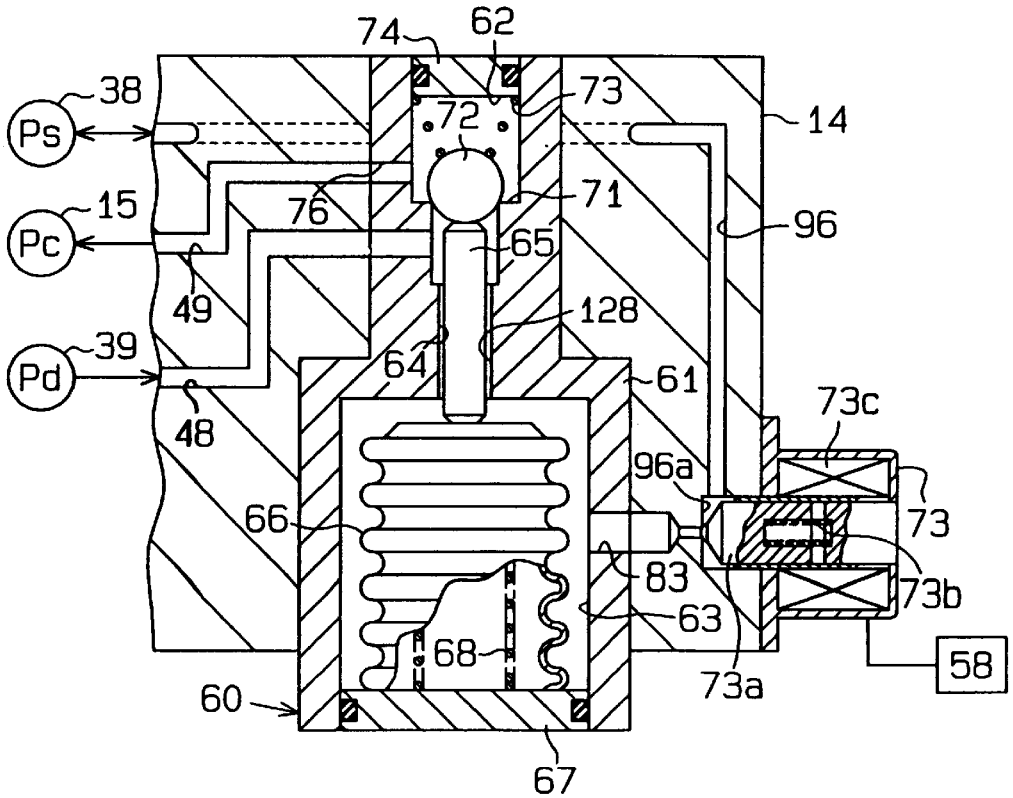
FIG. 17 is a schematic cross-sectional view showing a control valve and a valve mechanism employed in a compressor according to a tenth embodiment of the present invention.

In a tenth embodiment, as shown in FIG. 17, the sixth embodiment may be modified such that the lower region of the valve chamber 62 is connected to the discharge chamber 39 and the upper region of the valve chamber 62 is connected to the crank chamber 15. In this structure, the force produced by the difference between the discharge pressure Pd and the pressure Pc is applied to the valve body 75 in addition to the force of the spring 68. Further, a clearance 128 extends between the wall of the guide bore 64 and the rod 65 to connect the lower region of the valve chamber 62 with the pressure chamber 63. Thus, the high-pressure refrigerant gas that enters the valve chamber 62 from the discharge chamber 39 further flows into the pressure chamber 63. In this structure, a simple machining process is carried out to connect the valve chamber 62 and the pressure chamber 63 to each other.

Eleventh Embodiment

Figure 18:
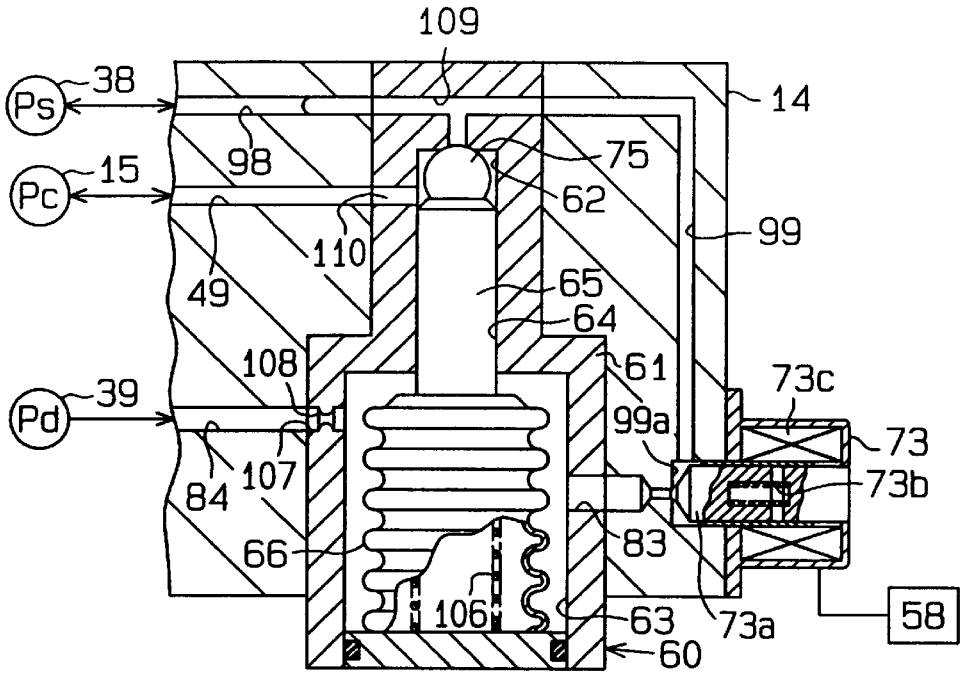
FIG. 18 is a schematic cross-sectional view showing a control valve and a valve mechanism employed in a compressor according to an eleventh embodiment of the present invention.

In an eleventh embodiment, as shown in FIG. 18, the seventh embodiment may be modified such that the suction chamber 38 is connected to the top end of the valve chamber 62 and such that the crank chamber 15 is connected to the side of the valve chamber 38. Like the seventh embodiment, the refrigerant gas in the crank chamber 15 is released toward the suction chamber 38 based on the pressure Pk of the pressure chamber 63.

Twelfth Embodiment

Figure 19:
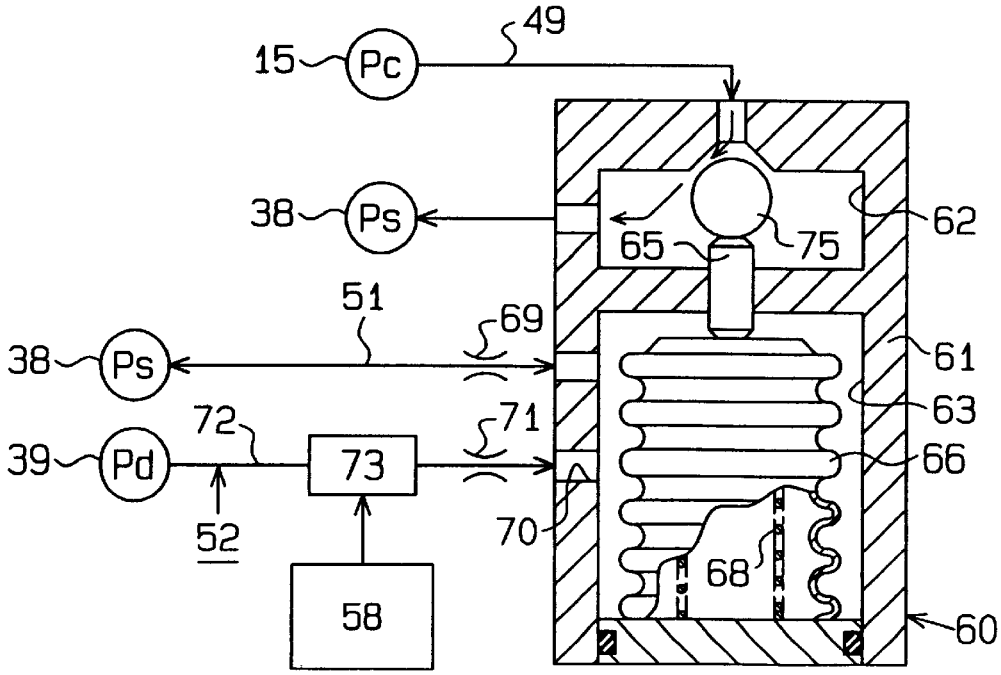
FIG. 19 is a schematic cross-sectional view showing a control valve employed in a compressor according to a twelfth embodiment of the present invention.
Figure 20:
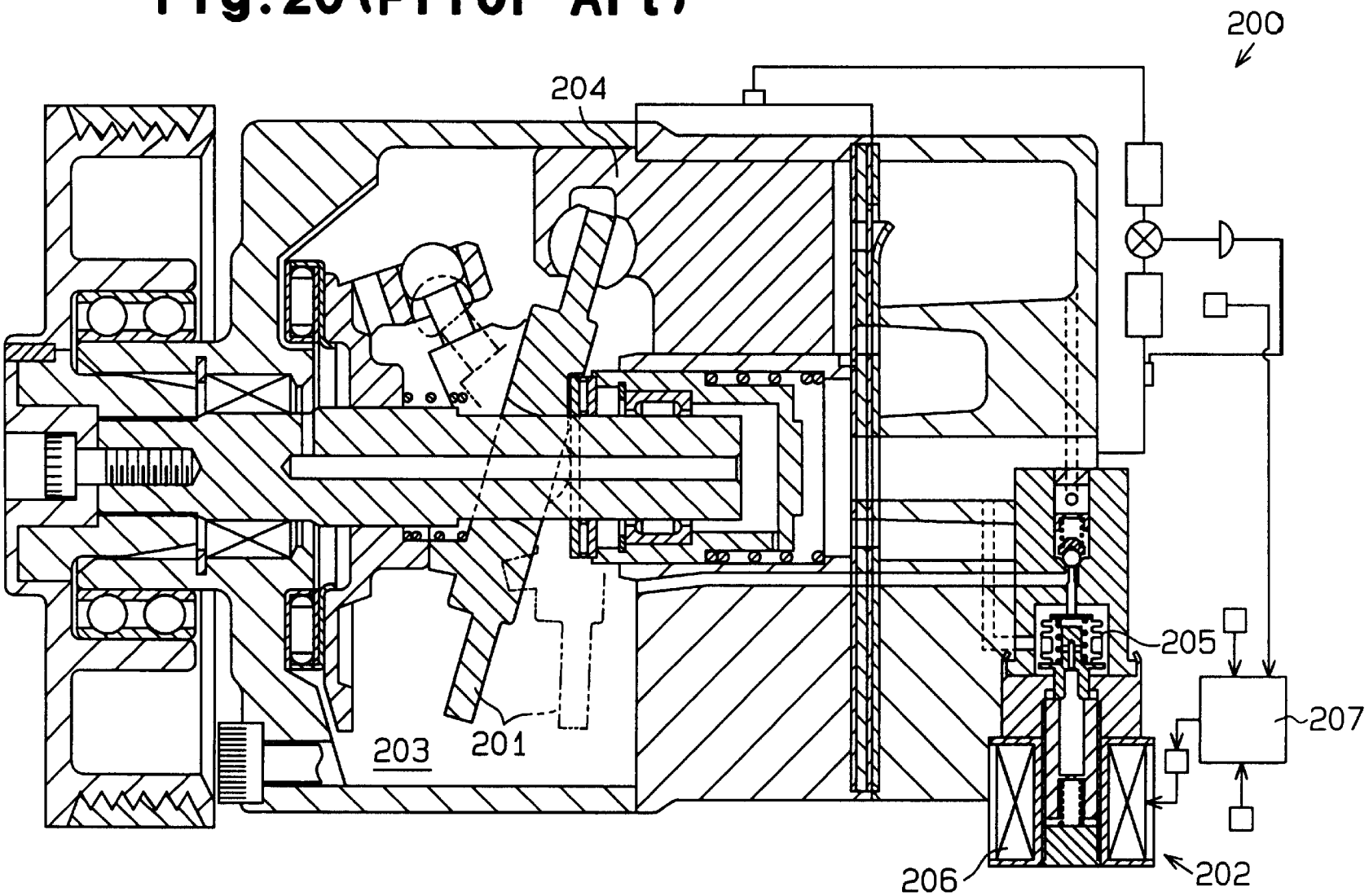
Fig.20(Prior Art)
FIG. 20 is a cross-sectional view showing a prior art compressor.

In a twelfth embodiment, as shown in FIG. 19, the seventh embodiment may be modified such that the valve chamber 62 is arranged in the passage 49, which connects the suction chamber 38 and the crank chamber 15. In this embodiment, the amount of high-pressure refrigerant gas sent into the pressure chamber 63 from the discharge chamber 39 is varied to change the suction pressure threshold value Pset.

It should be apparent to those skilled in the art that the present invention may be embodied in many other specific forms without departing from the spirit or scope of the invention. For example, the present invention may be embodied as described below.

In the sixth embodiment, the passage 97 extending through the valve body 75 and the rod 65 may be replaced by a communication passage extending through the valve housing 61 to connect the upper region of the valve chamber 62 to the pressure chamber 63. In this structure, the high-pressure refrigerant gas in the discharge chamber 39 flows into the pressure chamber 63 through the communication passage. Thus, this structure has the same advantages as the sixth embodiment.

The electromagnetic valve 73 employed in the first to eighth embodiments may be replaced by an electromagnetic valve that can be controlled to maintain a partially opened state. In such structure, the suction pressure threshold value Pset is selected from three values. Furthermore, the power of the engine 20 is distributed appropriately between the power train and the compressor 10. Thus, the driving performance of the vehicle and the cooling performance are both maintained at a high level.

The electromagnetic valve 73 employed in the first to eighth embodiments is shifted between two positions. However, an electromagnetic valve that continuously varies its opening size in accordance with a supply current may be employed instead of the electromagnetic valve 73. In this case, the controller 58 may vary the level of the current. In this structure, the suction pressure threshold value Pset is varied continuously. Thus, the operation of the compressor 10 may be more finely controlled.

In the first to eighth embodiments, the control valve 60 need not be incorporated in the compressor 10.

In the first to eighth embodiments, the pressure chamber 63 may be connected with the central bore 27 or the suction passage 28.

In the first to eighth embodiments, the valve chamber 62 may be connected to the central bore 27 or the suction passage 28.

The present invention may also be applied to a wobble plate type compressor. Furthermore, the compressor may be connected to the engine by an electromagnetic clutch.

In the first to eighth embodiments, the control valve 60 is actuated in accordance with the suction pressure Ps communicated to the pressure chamber 63. However, a control valve that is actuated in accordance with the crank pressure Pc communicated to the pressure chamber 63 may be employed instead. In this case, the suction pressure Ps is varied in accordance with changes in the threshold value.

Therefore, the present examples and embodiments are to be considered as illustrative and not restrictive, and the invention is not to be limited to the details given herein, but may be modified within the scope and equivalence of the appended claims.

What is claimed is:

1. A control valve installed in a variable displacement compressor for compressing gas, wherein the compressor has a discharge pressure region, a suction pressure region, and a crank chamber, which accommodates a crank mechanism for compressing the gas, wherein the pressure in the discharge pressure region is higher than that of the suction pressure region, wherein the control valve changes the displacement of the compressor by controlling a difference between the pressure in the crank chamber and one of the pressure in the discharge pressure region and the suction pressure region, the control valve comprising:

a pressure sensitive chamber connected to a control region, which is one of the discharge pressure region and the suction pressure region;

a first passage connecting the crank chamber to the control region;

a valve chamber located in the first passage;

a valve body accommodated in the valve chamber for selectively closing and opening the first passage;

a displaceable pressure sensitive mechanism connected to the valve body and accommodated in the pressure sensitive chamber, wherein the displacement of the pressure sensitive mechanism causes the valve body to move between an open position and a closed position, wherein the pressure sensitive mechanism produces a force for determining an initial threshold pressure value at which the valve body is switched between the open position and the closed position; and a controller for controlling a pressure in the pressure sensitive chamber, by supplying gas from the discharge pressure region to the pressure sensitive chamber or by discharging gas from the pressure sensitive chamber to the suction pressure region, to change the threshold value from the initial threshold value to a second threshold value, wherein the pressure sensitive mechanism functions in accordance with the pressure of the pressure sensitive chamber, and wherein the valve body behaves in accordance with the threshold value selected by the controller.

2. The control valve according to claim 1 further comprising:

a second passage connecting the discharge pressure region to the pressure sensitive chamber; and an additional valve located on the second passage;

wherein the controller controls the additional valve to regulate the amount of gas supplied from the discharge pressure region to the pressure sensitive chamber.

3. The control valve according to claim 1 further comprising:

a third passage connecting the discharge pressure region to the pressure sensitive chamber;

a fixed throttle located in the third passage;

a fourth passage connecting the pressure sensitive chamber to the suction pressure region; and an additional valve located in the fourth passage;

wherein the controller controls the additional valve to regulate gas flow from the pressure sensitive chamber to the suction pressure region.

4. The control valve according to claim 1, wherein the compressor is installed in a vehicle, and wherein the controller detects a driving state of the vehicle and controls the pressure in the pressure sensitive chamber according to the driving state.

5. The control valve according to claim 2, wherein the compressor is driven by an internal combustion engine having an intake passage, wherein the control valve further includes a valve mechanism located adjacent to the intake passage, and wherein the valve mechanism controls an opening size of the second passage based on a vacuum pressure in the intake passage.

6. The control valve according to claim 3, wherein the fourth passage includes a fifth passage and a sixth passage, wherein the additional valve is located in the fifth passage and the fixed throttle is located in the sixth passage.

7. The control valve according to claim 3, wherein the additional valve includes an additional valve body for selectively closing and opening the fourth passage, a spring for urging the additional valve body to close the fourth passage, and an excitation coil for urging the additional valve body to open the fourth passage against the urging force of the spring when excited, wherein the additional valve functions as a variable throttle to keep the difference between the pressure of the pressure sensitive chamber and that of the suction pressure region constant when the coil is not excited.

8. The control valve according to claim 7 further comprising a through hole connecting the valve chamber to the pressure sensitive chamber.

9. The control valve according to claim 7, wherein the fourth passage communicates with the valve chamber.

10. The control valve according to claim 1, wherein the pressure sensitive mechanism includes a bellows accommodated in the pressure sensitive chamber and a spring accommodated in the bellows for expanding the bellows.

11. The control valve according to claim 10, wherein the valve chamber is located between the crank chamber and the discharge pressure region, wherein a force based on the pressure difference between the pressure in the crank chamber and the pressure in the discharge pressure region is applied on the valve body in conjunction with the force of the spring.

12. The control valve according to claim 3 further comprises a select valve located in the first passage to change the direction of the gas flow in the valve chamber.

13. A variable displacement compressor for compressing gas, comprising:

a crank mechanism for compressing the gas;

a crank chamber for accommodating the crank mechanism;

a discharge pressure region and a suction pressure region formed in the compressor, wherein the pressure in the discharge pressure region is higher than that of the suction pressure region;

a control valve for changing the displacement of the compressor by controlling a difference between the pressure in the crank chamber and the pressure in a control region, which is one of the discharge pressure region and the suction pressure region, wherein the control valve includes:

a pressure sensitive chamber connected to the control region;

a first passage connecting the crank chamber to the control region;

a valve chamber located in the first passage;

a valve body accommodated in the valve chamber for selectively closing and opening the first passage; and a displaceable pressure sensitive mechanism connected to the valve body and accommodated in the pressure sensitive chamber, wherein the displacement of the pressure sensitive mechanism causes the valve body to move between an open position and a closed position wherein the pressure sensitive mechanism produces a force for determining an initial threshold pressure value at which the valve body is switched between the open position and the closed position; and a controller for controlling the pressure in the pressure sensitive chamber, by supplying gas from the discharge pressure region to the pressure sensitive chamber or by discharging gas from the pressure sensitive chamber to the suction pressure region, to change the threshold value from the initial value to a second value, wherein the pressure sensitive mechanism functions in accordance with the pressure of the pressure sensitive chamber, and wherein the valve body behaves in accordance with the threshold value selected by the controller.

14. A method for controlling a displacement of a variable displacement compressor installed in a vehicle, wherein the compressor has a discharge pressure region, a suction pressure region, a crank chamber, which accommodates a crank mechanism for compressing gas, and a control valve, wherein the pressure in the discharge pressure region is higher than that of the suction pressure region, wherein the control valve has a valve body for selectively closing and opening a passage that connects the crank chamber to one of the discharge pressure region and the suction pressure region, a pressure sensitive chamber connected to one of the discharge pressure region and the suction pressure region, wherein the control valve changes the displacement of the compressor by regulating the difference between the pressure in the crank chamber and one of the pressure in the discharge pressure region and the pressure in the suction pressure region, wherein the method includes the steps of:

detecting a driving state of the vehicle; and supplying gas from the discharge pressure region to the pressure sensitive chamber to increase the pressure in the pressure sensitive chamber in response to the driving state.

15. The control method according to claim 14 further including discharging the gas from the pressure sensitive chamber to the suction pressure region to decrease the pressure in the pressure sensitive chamber.

* * * * *